US009789709B2

(12) United States Patent
Saiga et al.

(10) Patent No.: US 9,789,709 B2
(45) Date of Patent: Oct. 17, 2017

(54) IMAGE FORMING APPARATUS

(71) Applicants: Soichi Saiga, Tokyo (JP); Keisuke Sekine, Kanagawa (JP); Tomonori Naito, Kanagawa (JP); Shinichiro Naruse, Kanagawa (JP)

(72) Inventors: Soichi Saiga, Tokyo (JP); Keisuke Sekine, Kanagawa (JP); Tomonori Naito, Kanagawa (JP); Shinichiro Naruse, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/096,423

(22) Filed: Apr. 12, 2016

(65) Prior Publication Data

US 2016/0297212 A1 Oct. 13, 2016

(30) Foreign Application Priority Data

Apr. 13, 2015 (JP) ..... 2015-081830

(51) Int. Cl.

| | |
|---|---|
| ***B41J 11/70*** | (2006.01) |
| ***B41J 11/66*** | (2006.01) |
| ***B26D 5/00*** | (2006.01) |
| ***B26D 1/04*** | (2006.01) |

(52) U.S. Cl.

CPC ..... *B41J 11/663* (2013.01); *B26D 1/045* (2013.01); *B26D 5/005* (2013.01); *B41J 11/706* (2013.01)

(58) Field of Classification Search

USPC ..... 347/104

See application file for complete search history.

(56) References Cited

U.S. PATENT DOCUMENTS

| | | | | | |
|---|---|---|---|---|---|
| 4,979,838 | A | * | 12/1990 | Yokota | B41J 11/706 101/226 |
| 5,296,872 | A | * | 3/1994 | Caamano | B26D 7/27 346/24 |
| 5,431,077 | A | * | 7/1995 | Murakami | B26D 1/205 83/105 |
| 5,782,496 | A | * | 7/1998 | Casper | G09F 3/10 283/101 |

(Continued)

FOREIGN PATENT DOCUMENTS

| | | | |
|---|---|---|---|
| ES | WO 2013101126 A1 * | 7/2013 | G06K 15/105 |
| JP | 2014-151482 | 8/2014 | |

*Primary Examiner* — Erica Lin
*Assistant Examiner* — Lily Kemathe
(74) *Attorney, Agent, or Firm* — Cooper & Dunham LLP

(57) ABSTRACT

An image forming apparatus includes a sheet feeder, a carriage, a cutter, a cutter unit, and a controller. A first standby position and a second standby position are disposed on both ends of a range of movement of the carriage. The carriage does not contact the cutter unit at each of the first standby position and the second standby position. The controller is configured to control the carriage and the cutter unit to overlappingly move. In an image recording condition in which images are consecutively recorded in a plurality of pages on a sheet, the controller is configured to change a direction of movement of the carriage at a leading end of a page so that the direction of movement of the carriage is the same as a direction of movement of the cutter unit at a sheet cutting position at which the cutter cuts the sheet.

11 Claims, 18 Drawing Sheets

(56) References Cited

U.S. PATENT DOCUMENTS 5,881,623 A * 3/1999 Otani ..... B26D 1/245 83/455
5,911,530 A * 6/1999 Hinojosa ..... B26D 1/205 400/621
5,954,439 A * 9/1999 Brannan ..... B41J 11/706 400/621
6,260,457 B1 * 7/2001 Hakkaku ..... B26D 7/025 400/621
6,302,605 B1 * 10/2001 Kanbe ..... B26D 3/12 400/621
6,315,474 B1 * 11/2001 Giles ..... B26D 1/0006 346/24
6,341,548 B1 * 1/2002 Hirahata ..... B26F 1/3813 83/699.41
6,454,475 B2 * 9/2002 Giles ..... B26D 1/0006 346/24
6,721,060 B1 * 4/2004 Kawamura ..... B26D 1/245 358/1.3
6,732,619 B2 * 5/2004 Carriere ..... B26D 1/085 101/93.07
6,830,304 B2 * 12/2004 Suzuki ..... B41J 11/706 347/101
6,832,537 B2 * 12/2004 Takabatake ..... B26D 1/0006 83/508
7,190,492 B2 * 3/2007 Hakkaku ..... B41J 11/663 347/147
7,322,762 B2 * 1/2008 Murata ..... B41J 3/4075 101/93.07
8,500,350 B2 * 8/2013 Kumai ..... B26D 1/245 400/619
8,529,145 B2 * 9/2013 Carton Cordero ..... B26D 1/245 400/621
8,657,402 B2 * 2/2014 Maeyama ..... B26D 1/045 347/104
8,657,512 B2 * 2/2014 Crystal ..... B41J 3/4073 400/595
8,764,182 B2 * 7/2014 Ogawa ..... B26D 1/045 347/101
8,807,855 B2 * 8/2014 Suzuki ..... B26D 7/2628 400/611
8,911,168 B2 * 12/2014 Yoshinuma ..... B26D 1/185 400/621
8,955,962 B2 * 2/2015 Maeyama ..... B26D 1/245 347/104
8,960,064 B2 * 2/2015 Supron ..... B26D 1/015 83/508
9,056,498 B2 * 6/2015 Maeyama ..... B41J 11/006
9,227,436 B2 * 1/2016 De Monet ..... G06K 15/105
2001/0055508 A1 * 12/2001 Giles ..... B26D 1/0006 400/621.2
2003/0210290 A1 * 11/2003 Suzuki ..... B41J 11/706 347/9
2008/0181711 A1 * 7/2008 Monclus ..... B26D 1/0006 400/621
2009/0196673 A1 * 8/2009 Akatsu ..... B41J 11/006 400/621
2009/0226236 A1 * 9/2009 Yamashita ..... B26D 1/185 400/621
2009/0232577 A1 * 9/2009 Kumai ..... B26D 1/245 400/621
2010/0238247 A1 * 9/2010 Doo ..... B41J 11/002 347/102
2011/0007119 A1 * 1/2011 Baba ..... B41J 3/407 347/104
2011/0052300 A1 * 3/2011 Akatsu ..... B26D 1/185 400/621
2011/0211210 A1 * 9/2011 Niihara ..... B41J 15/02 358/1.12
2011/0280644 A1 * 11/2011 Toyoshima ..... B26D 1/205 400/621
2012/0062927 A1 * 3/2012 Tsuji ..... B41J 11/70 358/1.13
2012/0139987 A1 * 6/2012 Maeyama ..... B26D 1/045 347/16
2012/0140010 A1 * 6/2012 Ogawa ..... B26D 1/045 347/104
2012/0140011 A1 * 6/2012 Yamada ..... B26D 1/045 347/104
2012/0148326 A1 * 6/2012 Ipponyari ..... B26D 1/045 400/621
2012/0200885 A1 * 8/2012 Matsuzawa ..... B41J 11/46 358/1.15
2012/0210838 A1 * 8/2012 Maeyama ..... B26D 1/245 83/70
2012/0222530 A1 * 9/2012 Yoshinuma ..... B41J 11/706 83/401
2012/0222531 A1 * 9/2012 Ogawa ..... B65H 35/04 83/401
2012/0222532 A1 * 9/2012 Yamada ..... B65H 35/04 83/401
2012/0297945 A1 * 11/2012 Cordero ..... B26D 1/245 83/56
2013/0095990 A1 * 4/2013 Maeyama ..... B41J 11/006 493/31
2013/0195536 A1 8/2013 Yoshinuma et al.
2013/0271545 A1 * 10/2013 Nagashima ..... B41J 11/70 347/104
2013/0302077 A1 * 11/2013 Kumai ..... B26D 1/245 400/621
2014/0169855 A1 * 6/2014 Crystal ..... B41J 3/4073 400/621
2015/0166293 A1 * 6/2015 Hamamura ..... B41J 11/663 358/1.12
2016/0297212 A1 * 10/2016 Saiga ..... B41J 11/663
2017/0087890 A1 * 3/2017 Masuda ..... B41J 11/70

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2015-081830, filed on Apr. 13, 2015, in the Japan Patent Office, the entire disclosure of which is hereby incorporated by reference herein.

BACKGROUND

Technical Field

Aspects of the present disclosure relate to an image forming apparatus, such as a printer, a copier, or a facsimile machine, and more specifically to an image forming apparatus including a sheet cutting device to cut a rolled sheet to a desired length.

Related Art

Image forming apparatuses are used as printers, facsimile machines, copiers, plotters, or multi-functional devices having two or more of the foregoing capabilities. As one type of image forming apparatus, an image forming apparatus is known that intermittently feeds a long-size rolled sheet (hereinafter, rolled sheet) in a predetermined feed direction (hereinafter, sheet feed direction) to form an image on the rolled sheet. Such an image forming apparatus typically has a sheet cutting device to cut the rolled sheet to a desired length by moving a cutter in a width direction perpendicular to the sheet feed direction.

SUMMARY

In an aspect of this disclosure, there is provided an image forming apparatus that includes a sheet feeder, a carriage, a cutter, a cutter unit, and a controller. The sheet feeder is configured to intermittently feed a sheet on a sheet feed path. The carriage mounts a recording head. The recording head is configured to discharge ink onto the sheet on the sheet feed path when the carriage reciprocally moves in a width direction perpendicular to a sheet feed direction in which the sheet feeder feeds the sheet. The cutter is configured to cut the sheet to a length. The cutter unit is movable in the width direction and holds the cutter. The cutter unit is disposed so that a range of movement of the cutter in cutting of the sheet overlaps a range of movement of the carriage. The controller is configured to control movement of the cutter, movement of the carriage, and operation of the sheet feeder. A first standby position and a second standby position are disposed on both ends of the range of movement of the carriage. The carriage does not contact the cutter unit at each of the first standby position and the second standby position. The controller is configured to control the carriage and the cutter unit to overlappingly move. In an image recording condition in which images are consecutively recorded in a plurality of pages on the sheet, the controller is configured to change a direction of movement of the carriage at a leading end of a page so that the direction of movement of the carriage is the same as a direction of movement of the cutter unit at a sheet cutting position at which the cutter cuts the sheet.

In another aspect of this disclosure, there is provided an image forming apparatus that includes a sheet feeder, a carriage, a cutter, a cutter unit, and a controller. The sheet feeder is configured to intermittently feed a sheet on a sheet feed path. The carriage mounts a recording head. The recording head is configured to discharge ink onto the sheet on the sheet feed path when the carriage reciprocally moves in a width direction perpendicular to a sheet feed direction in which the sheet feeder feeds the sheet. The cutter is configured to cut the sheet to a length. The cutter unit is movable in the width direction and holds the cutter. The cutter unit is disposed so that a range of movement of the cutter in cutting of the sheet overlaps a range of movement of the carriage. The controller is configured to control movement of the cutter, movement of the carriage, and operation of the sheet feeder. A first standby position and a second standby position are disposed on both ends of the range of movement of the carriage. The carriage does not contact the cutter unit at each of the first standby position and the second standby position. The controller is configured to control the carriage and the cutter unit to overlappingly move. In an image recording condition in which images are consecutively recorded in a plurality of pages on the sheet, the controller is configured to change a width of an image in the sheet feed direction recorded by a single movement of the carriage by when a sheet cut position of the sheet, at which the sheet is cut by the cutter, arrives at a sheet cutting position of the cutter, at which the cutter cuts the sheet, so that the direction of movement of the carriage is the same as a direction of movement of the cutter unit at the sheet cutting position.

In still another aspect of this disclosure, there is provided an image forming method that includes calculating, determining, feeding, and driving. The calculating calculates, from a feed distance of a sheet to a sheet cutting position of the cutter at which a cutter of a cutter unit of an image forming apparatus cuts the sheet, a number of times of scanning of a carriage to be performed by when a sheet cut position of the sheet, at which the sheet is cut by the cutter, arrives at the sheet cutting position. The determining determines whether the number of times of scanning of the carriage is even or odd, to determine a writing direction of the carriage. The feeding feeds the sheet so that the sheet cut position matches the sheet cutting position. The driving drives the cutter unit during print operation of the carriage.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
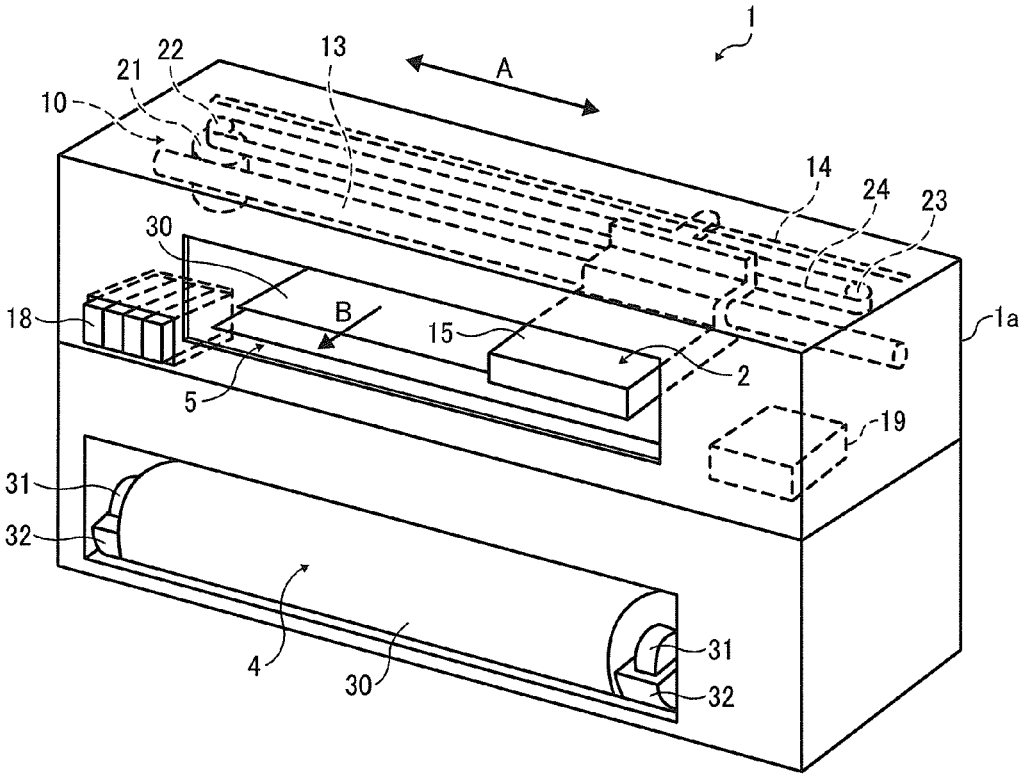
FIG. 1 is a schematic perspective view of an inkjet recording apparatus including a sheet cutting device according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

First Embodiment

Referring now to the drawings, wherein like reference numerals designate identical or corresponding parts throughout the several views, exemplary embodiments of the present disclosure are described below.

FIGS. 1 to 17 are illustrations of a sheet cutting device and an image forming apparatus according to an embodiment (a first embodiment) of the present disclosure. In FIGS. 1 to 17, an inkjet recording apparatus is illustrated as an example of the image forming apparatus.

Figure 2:
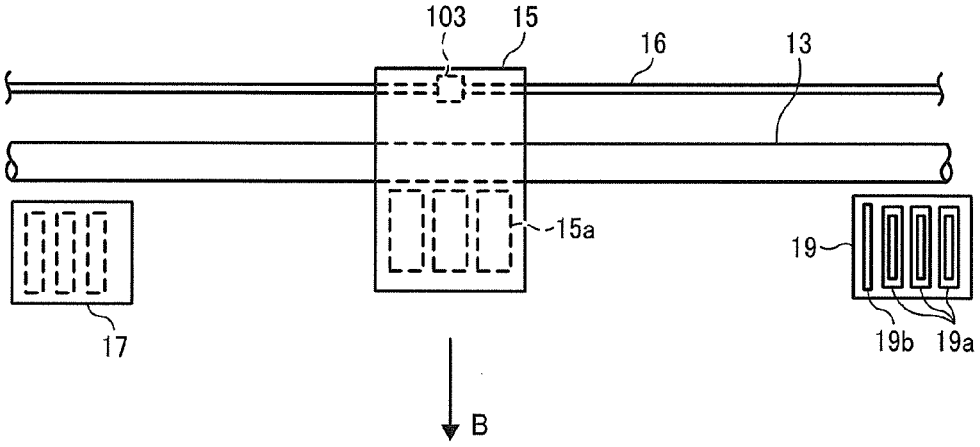
FIG. 2 is a schematic plan view of a carriage illustrated in FIG. 1.

In FIGS. 1 and 2, an inkjet recording apparatus 1 as the image forming apparatus according to this embodiment is a serial inkjet recording apparatus that moves an inkjet recording head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image.

Figure 16:
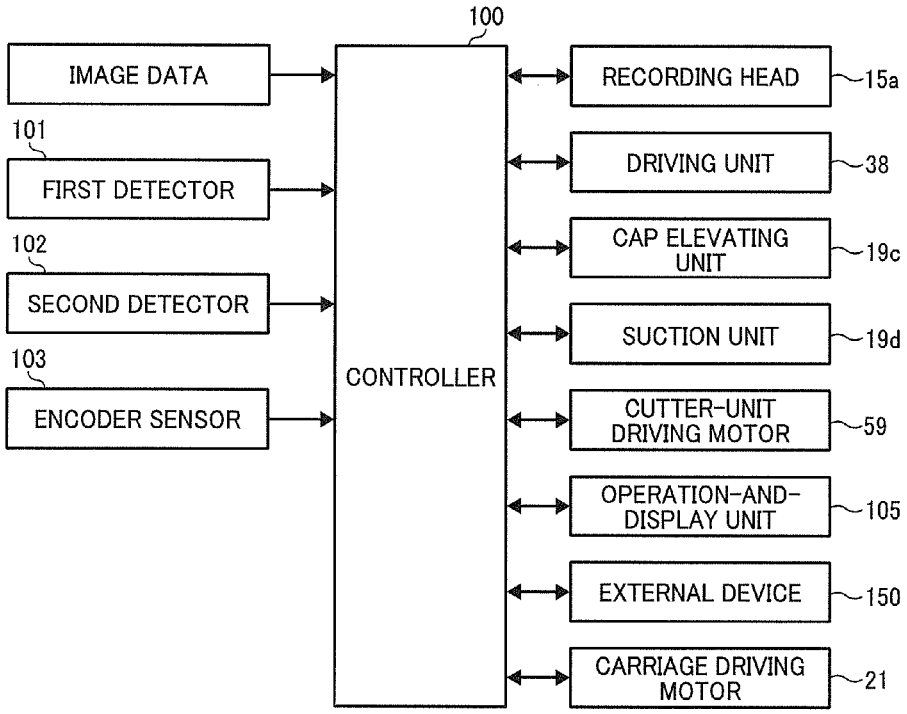
FIG. 16 is a schematic block diagram of a control configuration of an inkjet recording apparatus according to an exemplary embodiment of the present disclosure.

The inkjet recording apparatus 1 includes an image forming section 2 as an image forming device, a sheet feed section 3, a rolled sheet storage section 4, a sheet cutting device 5, and a controller 100 (see FIG. 16). The image forming section 2, the sheet feed section 3, the rolled sheet storage section 4, the sheet cutting device 5, and the controller 100 are disposed within an apparatus body 1*a*. The sheet feed section 3 includes a sheet feeder according to an embodiment of the present disclosure.

In the image forming section 2, a guide rod 13 and a guide rail 14 are laterally bridged between side plates, and a carriage unit 15 is supported by the guide rod 13 and the guide rail 14 so as to be slidable in a direction indicated by arrow A in FIG. 1.

The term "slide" used herein represents that the carriage unit 15 moves on the guide rod 13 and the guide rail 14 in the direction indicated by arrow A while contacting the guide rod 13 and the guide rail 14.

The carriage unit 15 mounts recording heads 15*a* (see FIG. 2) to discharge droplets of ink of different colors, e.g., black (K), yellow (Y), magenta (M), and cyan (C). The recording heads 15*a* are integrally molded with sub tanks to supply ink to the respective recording heads 15*a*.

Figure 17:
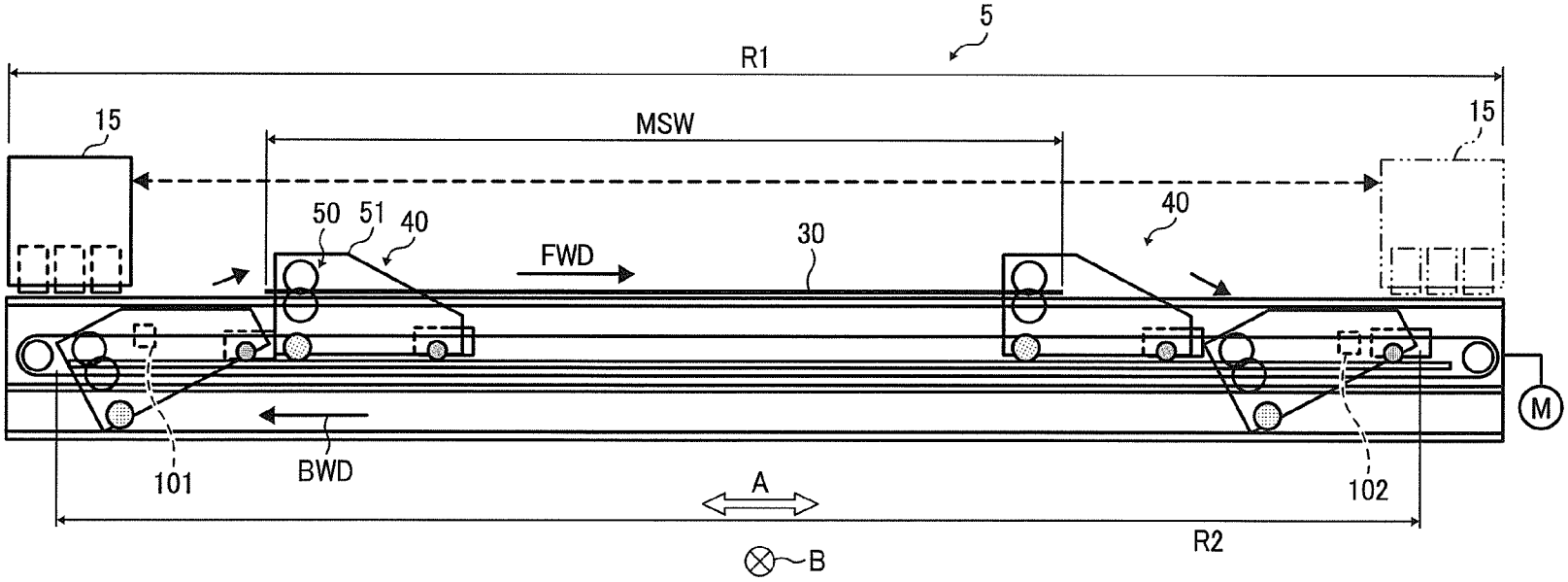
FIG. 17 is a back view of a range of movement of the carriage and a range of movement of the cutter holder according to an embodiment of the present disclosure.

A main scanning assembly 10 reciprocally moves the carriage unit 15 for scanning in a main scanning direction, that is, the sheet width direction indicated by arrow A in FIG. 1. For example, a carriage home position (indicated by solid line in FIG. 17) and a dummy discharge position (indicated by broken line in FIG. 17) are disposed away from each other in the sheet width direction outside a range of a maximum sheet width MSW in which an image can be recorded on the rolled sheet 30. As illustrated in FIG. 17, the carriage unit 15 is movable between the carriage home position and the dummy discharge position in the sheet width direction.

Hereinafter, the range of movement of the carriage unit 15 in the sheet width direction (indicated by arrow R1 in FIG. 17) may be referred to as "carriage movement range". Accordingly, the dummy discharge position and the carriage home position are disposed at positions at which the carriage unit 15 can avoid contact with a cutter unit 40 (see FIG. 17) on both ends of the carriage movement range. Each of the dummy discharge position and the carriage home position is located at a retracted position outside a range of movement of the cutter unit 40. In this embodiment, the carriage home position corresponds to a first standby position, and the dummy discharge position corresponds to a second standby position.

The main scanning assembly 10 includes a carriage driving motor 21 disposed at the front left side of the inkjet recording apparatus 1 (the left side seen from the front side of the apparatus in FIG. 1) in the sheet width direction. The main scanning assembly 10 includes a drive pulley 22 driven and rotated by the carriage driving motor 21, a driven pulley 23 disposed at a front right side of the inkjet recording apparatus 1 (the right side seen from the front side of the apparatus in FIG. 1) in the sheet width direction, and a belt 24 wound around the drive pulley 22 and the driven pulley 23.

A tension spring applies tension to the driven pulley 23 outward, that is, in a direction away from the drive pulley 22. A portion of the belt 24 is secured to and held by a belt securing portion at a rear side of the carriage unit 15 to draw the carriage unit 15 in the sheet width direction.

To detect a main scanning position of the carriage unit 15 in the main scanning direction, as illustrated in FIG. 2, an encoder sheet 16 is disposed along the sheet width direction. An encoder sensor 103 disposed at the carriage unit 15 reads the encoder sheet 16 to detect the main scanning position of the carriage unit 15.

In a recording area of a main scanning region of the carriage unit 15, the rolled sheet 30 is intermittently fed by the sheet feed section 3 in a direction perpendicular to the sheet width direction, that is, a sheet feed direction indicated by arrow B in FIGS. 1 and 2.

Outside the movement range R1 of the carriage unit 15 in the sheet width direction or at one end of the main scanning region on the front left side of the inkjet recording apparatus 1, main cartridges 18 are removably mounted to the apparatus body 1*a* to store the respective color inks to be supplied to the sub tanks of the recording heads 15*a*.

Additionally, as illustrated in FIG. 2, at a first side proximal to the dummy discharge position of the carriage movement range R1 (left side in FIG. 2), a dummy discharge receptacle 17 is disposed to store ink droplets not used for a recorded image but discharged for discharging thickened ink during dummy discharge operation. Under certain conditions, the recording heads 15*a* perform the dummy discharge at the dummy discharge position to maintain and recover desired discharging performance.

At a second side proximal to the carriage home position of the carriage movement range R1 (right side in FIG. 2), a capping position is located at which a maintenance assembly 19 is disposed to maintain and recover conditions of the recording heads 15*a*.

The maintenance assembly 19 includes caps 19*a* to cap nozzle faces 15*b* (see FIG. 4) of the recording heads 15*a* and a wiper blade 19*b* as a blade to wipe the nozzle faces 15*b*. The maintenance assembly 19 includes a cap elevating unit 19*c* (see FIG. 16) and a suction device 19*d* (see FIG. 16).

The cap elevating unit 19*c* moves up and down the caps 19*a* and the wiper blade 19*b*. The suction unit 19*d* is connected to the caps 19*a* to suck the recording heads 15*a* with the nozzle faces 15*b* capped with the caps 19*a*.

For example, after print operation or on detection of an abnormality of the cutter unit 40, the cap elevating unit 19*c* is driven to cap the nozzle faces 15*b* with the caps 19*a*.

When the suction unit 19*d* is activated with the nozzle faces 15*b* capped with the caps 19*a*, the internal space of each of the caps 19*a* is turned to a negative pressure, thus causing ink to be discharged from the nozzles into the caps 19*a*.

The discharged waste ink is drained into a waste-liquid tank. In some embodiments, for example, a dummy discharge receptacle may be disposed at the side proximal to the carriage home position and included in the maintenance assembly 19 with the caps 19*a* and the wiper blade 19*b*. Alternatively, two dummy discharge receptacles may be disposed at the carriage-home-position side and the dummy-discharge-position side.

The rolled sheet storage section 4 is a sheet feed unit into which the rolled sheet 30 is set as a sheet material for image recording. As the rolled sheet 30, rolled sheets of different widths can be set to the rolled sheet storage section 4.

The rolled sheet 30 includes a sheet shaft, and flanges 31 are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

Figure 3:
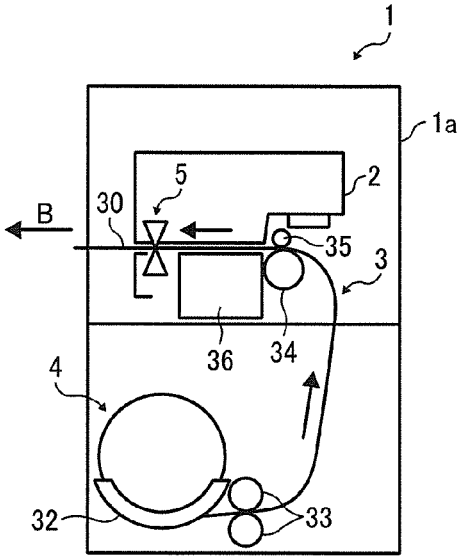
FIG. 3 is a schematic side view of the inkjet recording apparatus illustrated in FIG. 1.

As illustrated in FIG. 3, the sheet feed section 3 includes a pair of sheet feed rollers 33, a registration roller 34, a registration pressing roller 35, and a sheet suction feeding device 36. As illustrated in FIG. 3, the sheet feed section 3 further includes a driving unit 38 including, e.g., a drive motor to drive the pair of sheet feed rollers 33, the registration roller 34, the registration pressing roller 35. The pair of sheet feed rollers 33 feeds the rolled sheet 30 from the rolled sheet storage section 4 to the sheet feed path.

The registration roller 34 and the registration pressing roller 35 are disposed upstream from the image forming section 2 in the sheet feed direction to feed the rolled sheet 30 to the sheet cutting device 5 via an area below the image forming section 2.

The sheet suction feeding device 36 is disposed below the image forming section 2 via the sheet feed path and performs suctioning operation to attract the rolled sheet 30 onto a platen plate at an upper face of the sheet suction feeding device 36. Thus, the flatness of the rolled sheet 30 fed below the image forming section 2 is maintained along the platen plate.

After the rolled sheet 30 is fed from the rolled sheet storage section 4, the sheet feed section 3 feeds the rolled sheet 30 forward (toward the left side in FIG. 3) from the rear side (right side in FIG. 3) of the apparatus body 1*a* to a predetermined recording area below the image forming section 2.

When the rolled sheet 30 is fed to the recording area, the carriage unit 15 reciprocally moves back and forth in the sheet width direction and the recording heads 15*a* discharge ink droplets in accordance with image information. In addition, while the rolled sheet 30 is intermittently fed forward, the reciprocal movement of the carriage unit 15 and the discharge of ink droplets from the recording heads 15*a* (see FIG. 2) are repeatedly performed to serially record a desired image on the rolled sheet 30. Thus, the desired image is formed on the rolled sheet 30 in accordance with the image information.

After image formation, the sheet cutting device 5 cuts the rolled sheet 30 to a desired length, and a sheet cut from the rolled sheet 30 is ejected by sheet ejection rollers to a sheet ejection tray at the front side of the apparatus body 1*a*.

Next, the sheet cutting device 5 in this exemplary embodiment is described with reference to FIGS. 4 to 8.

Figure 4:
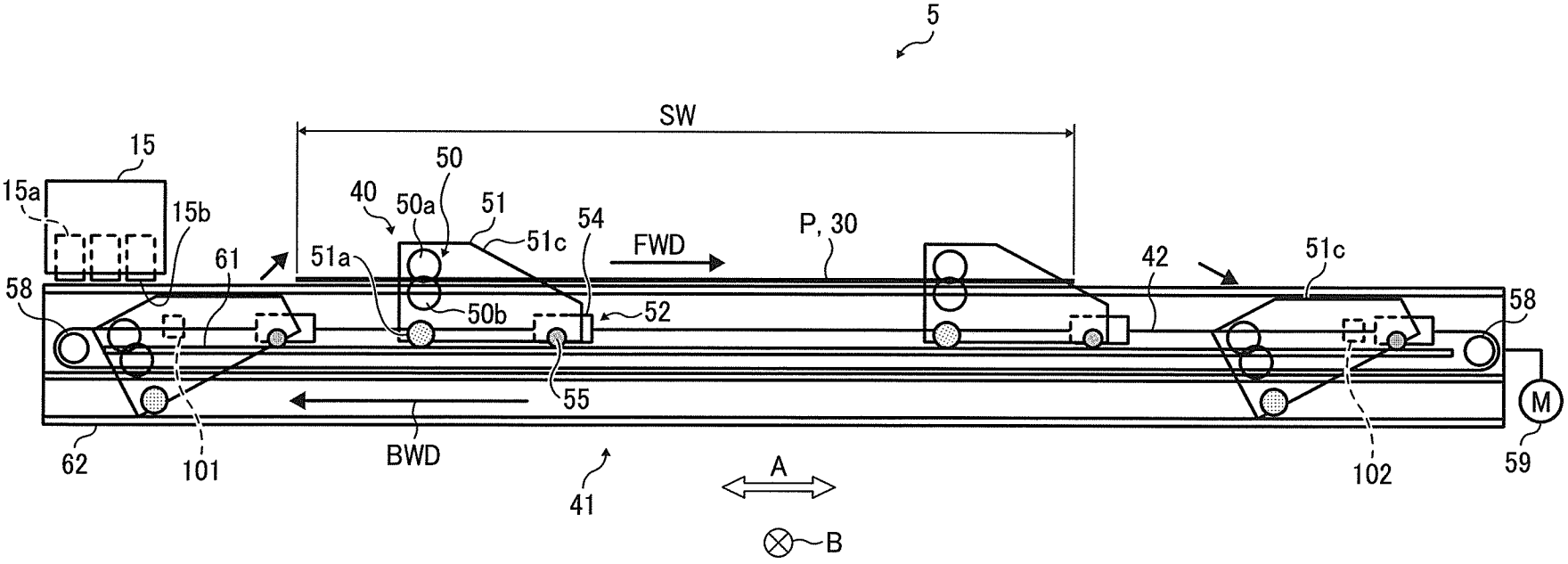
FIG. 4 is a schematic back view of the sheet cutting device illustrated in FIG. 1.

FIG. 4 is a schematic view of the sheet cutting device 5 seen from the back side of the apparatus body 1*a* (see FIG. 1).

Figure 5A:
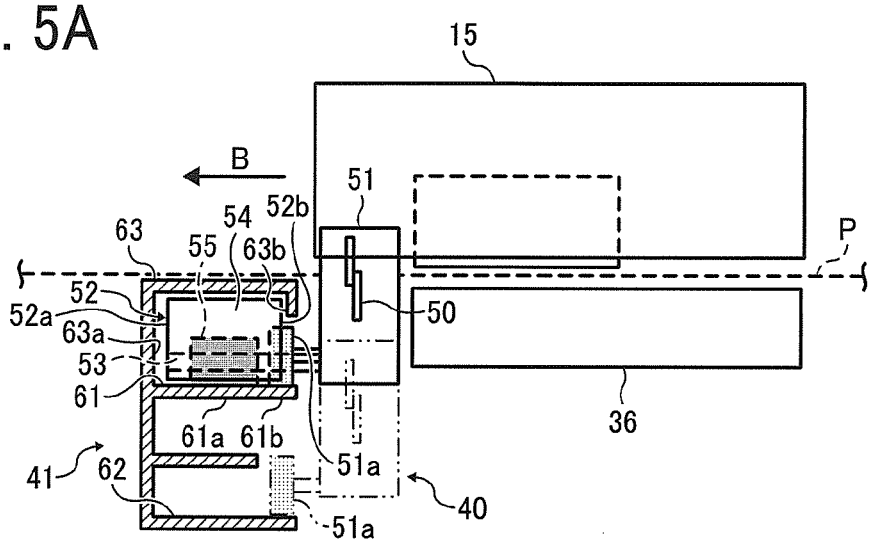
FIG. 5A is a partially cross-sectional side view of the sheet cutting device illustrated in FIG. 4.

FIG. 5A is a side view of a cross section of a portion of the sheet cutting device 5. In FIG. 5A, a position of a cutter housing 51 indicated by solid line represents a position at which the cutter unit 40 is in a cutting state (during movement on a forward path). Another position of the cutter housing 51 indicated by broken line represents a position at which the cutter unit 40 is in a retracted state (during movement on a backward path).

Figure 5B:
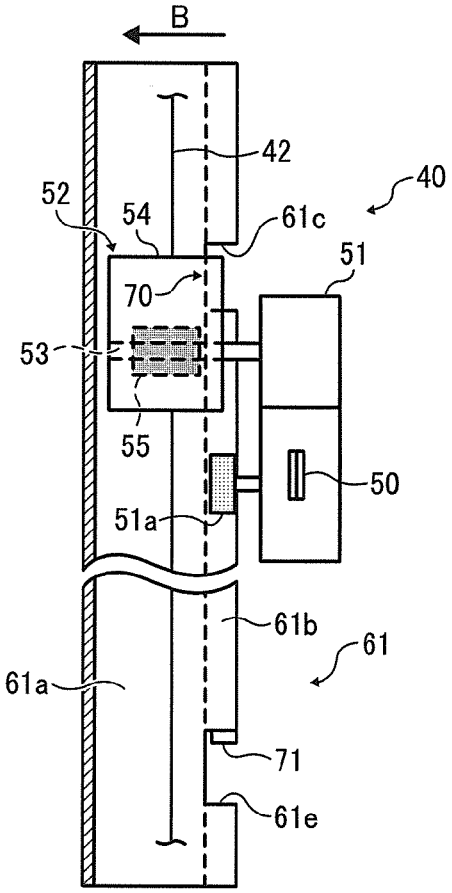
FIG. 5B is a partially cross-sectional plan view of the sheet cutting device illustrated in FIG. 4.

As illustrated in FIGS. 4 and 5A and 5B, the sheet cutting device 5 is disposed downstream from the image forming section 2 in the sheet feed direction (see FIG. 3) and includes a cutter 50, the cutter unit 40, and a guide 41, and a wire 42.

The cutter unit 40 includes the cutter housing 51 accommodating the cutter 50, a mover 52, and a rotation shaft 53 as a connector.

The cutter 50 is formed of a circular blade 50*a* and a circular blade 50*b* as blades disposed opposite each other via the rolled sheet 30. The cutter 50 is rotatably held by and accommodated in the cutter housing 51. The circular blade 50*a* and the circular blade 50*b* receive a driving force to rotate with movement of the cutter housing 51 in the sheet width direction indicated by arrow A in FIG. 4. The cutter 50 cuts the rolled sheet 30 fed along the sheet feed path to a desired length.

In other words, the cutter 50 cuts the rolled sheet 30 while rotating the circular blades 50*a* and 50*b*, thus allowing cutting of, e.g., a relatively thick rolled sheet. Additionally, the cutter 50 formed of the circular blades prevents a failure, such as uneven wearing of a particular portion as in a stationary blade.

The cutter housing 51 is reciprocally movable back and forth within a range of movement in the sheet width direction (hereinafter may be referred to as "cutter movement range") indicated by arrow R2 in FIG. 17. A first retracted position (left side in FIG. 17) and a second retracted position (right side in FIG. 17) of the cutter housing 51 are disposed at both ends of the cutter movement range R2.

The second retracted position is located at an end opposite the first retracted position in the cutter movement range R2. At the first retracted position and the second retracted position, the cutter housing 51 is retracted from the sheet feed path downward in a thickness direction of the rolled sheet 30 (hereinafter, sheet thickness direction), that is, the vertical direction.

Such a configuration prevents the cutter housing 51 from interfering with the carriage unit 15 at the first retracted position and the second retracted position. In this embodiment, the first retracted position is a home position (cutter home position) of the cutter housing 51.

The cutter housing 51 is connected to the mover 52 via the rotation shaft 53. The cutter housing 51 is rotatable in the sheet thickness direction around the rotation shaft 53 relative to the mover 52, that is, can circulate forward and in reverse within a predetermined angle range.

When the cutter housing 51 moves along the forward path (indicated by arrow FWD in FIG. 4) from the front right side to the front left side of the apparatus body 1*a* (see FIG. 1), the cutter 50 cuts the rolled sheet 30. In other words, the cutter housing 51 moves from the cutter home position (the first retracted position) to the second retracted position while cutting the rolled sheet 30.

By contrast, when the cutter housing 51 moves along the backward path (indicated by arrow BWD in FIG. 4) from the front left side to the front right side of the apparatus body 1*a* (see FIG. 1), the cutter housing 51 rotates downward relative to the mover 52 and moves to the cutter home position at a state in which the cutter housing 51 is shifted to the second retracted position.

In other words, after cutting of the rolled sheet 30, the cutter housing 51 is movable in the sheet width direction in the state in which the cutter housing 51 is retracted downward in the sheet thickness direction relative to the sheet feed path. As a result, on the backward path, the cutter housing 51 is placed away from the sheet feed path (indicated by broken line P in FIG. 5A) so as not to block the sheet feed path. The cutter housing 51 rotates upward relative to the mover 52 when the cutter housing 51 returns from the backward path (the first retracted position) to the forward path.

At both ends of the cutter movement range R2, for example, a first detector 101 and a second detector 102, such as transmissive sensors or micro switches, are disposed to detect the cutter housing 51. The first detector 101 and the second detector 102 detect that the cutter housing 51 is placed at the first retracted position and the second retracted position, respectively.

The position of the cutter housing 51 is detected with the first detector 101 and the second detector 102 and the movement of the cutter housing 51 is controlled with the controller 100.

The cutter housing 51 has a driven roller 51*a* at an upstream side (the left side in FIG. 4) in a direction of movement to cut the rolled sheet 30 (hereinafter, simply referred to as "cutting direction").

The driven roller 51*a* is rotatably disposed away from a drive roller 55 in the sheet width direction. The driven roller 51*a* moves on an upper guide rail 61 along the forward path of the cutter housing 51 and on a lower guide rail 62 along the backward path.

In other words, during movement of the cutter housing 51, the driven roller 51*a* acts as a positioning member to position the cutter housing 51 relative to the upper guide rail 61 and the lower guide rail 62. It is to be noted that the positioning member of the cutter housing 51 is not limited to the driven roller 51*a* but may be, for example, a circular-arc projection. However, preferably, the positioning member is a roller to reduce the influence of friction with the upper guide rail 61 and the lower guide rail 62 during movement of the cutter housing 51.

As illustrated in FIGS. 5A and 5B, the mover 52 is disposed away from the cutter housing 51 in the sheet feed direction and includes a body 54 and the drive roller 55. Within a range of movement of the apparatus body 1*a* (see FIG. 1) extending in the sheet width direction, the mover 52 is movable in the sheet width direction.

As illustrated in FIGS. 5A and 5B, the drive roller 55 is made of a rubber roller and secured to the rotation shaft 53 so that the drive roller 55 is rotatable with the rotation shaft 53. Accordingly, the drive roller 55 is rotatably held with the body 54 via the rotation shaft 53.

The mover 52 is connected to the wire 42 that is laterally bridged over a pair of pulleys 58 disposed at both sides of the apparatus body 1*a* in the sheet width direction. Of the pair of pulleys 58, one pulley 58 at the front left side of the apparatus body 1*a* (see FIG. 1) is connected to a cutter-unit drive motor 59.

Accordingly, the wire 42 circulates in the sheet width direction via the pulley 58 rotated by the cutter-unit drive motor 59. In other words, the wire 42 transmits a drawing force to the mover 52.

Accordingly, the wire 42 draws the mover 52 in the sheet width direction. As a result, the drive roller 55, while rotating, moves on the upper guide rail 61 with the circulation of the wire 42. The detailed configuration of the mover 52 is described later.

On switching the moving path between the forward path and the backward path, the cutter housing 51 pivots around the rotation shaft 53 of the drive roller 55 in the vertical direction. Thus, the cutter housing 51 switches between a first position with which, on the forward path, the cutter housing 51 cuts the rolled sheet 30 with the cutter 50 and a second position with which, on the backward path, the cutter housing 51 is retracted from the sheet feed path.

As illustrated in FIG. 5A, the drive roller 55 and the driven roller 51*a* are offset from each other in the sheet feed direction indicated by arrow B. For example, the driven roller 51*a* is arranged upstream from the drive roller 55 in the sheet feed direction.

As a result, with the drive roller 55 retained on the upper guide rail 61, the driven roller 51*a* is movable between the upper guide rail 61 and the lower guide rail 62, thus allowing the cutter housing 51 to pivot around the rotation shaft 53 of the drive roller 55. In FIG. 5A, the broken line P extending in the direction indicated by arrow B represents the sheet feed path.

In this embodiment, as illustrated in FIG. 5A, the cutter housing 51 is disposed within the width of the carriage unit 15 in the sheet feed direction. Alternatively, for example, the cutter housing 51 may be disposed away from the carriage unit 15 at the upstream or downstream side in the sheet feed direction.

When the cutter housing 51 is disposed away from the carriage unit 15 at the upstream side in the sheet feed direction, the rolled sheet 30 may be cut after image formation of the carriage unit 15. However, in such a case, since an image cannot be formed in an area near a trailing end of a cut sheet, image formation may be performed after the rolled sheet 30 is cut and the carriage unit 15 is moved.

As illustrated in FIG. 4, the cutter housing 51 has a slanted face 51*c* slanted at a predetermined angle from the sheet feed path (indicated by solid line P) toward the vertical direction. The slant angle of the slanted face 51*c* is set so that the slanted face 51*c* is parallel to the sheet feed path P when the cutter housing 51 moves along the backward path.

As illustrated in FIGS. 5A and 5B, the rotation shaft 53 connects the cutter housing 51 to the mover 52. The rotation shaft 53 rotates the cutter housing 51 in the sheet thickness direction relative to the mover 52 around a center axis of the rotation shaft 53.

The drive roller 55 is secured to a downstream end of the rotation shaft 53 in the sheet feed direction so that the drive roller 55 is rotatable with the drive roller 55. An upstream end of the rotation shaft 53 in the sheet feed direction is rotatably held by a bearing 51*b* (see FIG. 12) of the cutter housing 51.

As illustrated in FIG. 4, the guide 41 guides movement of the mover 52 in the sheet width direction. The guide 41 includes the upper guide rail 61 extending in the sheet width direction for a length that is at least longer than the sheet feed width indicated by arrow SW in FIG. 4 and the lower guide rail 62 disposed away from the sheet feed path and downward from the upper guide rail 61 in the vertical direction. The upper guide rail 61 is disposed below the mover 52.

As illustrated in FIG. 5A, the guide 41 includes an upper guide plate 63 above the upper guide rail 61. The upper guide plate 63 is disposed above the mover 52. The guide 41 forms the forward path of the cutter housing 51 on the upper guide rail 61 and the backward path of the cutter housing 51 on the lower guide rail 62.

Accordingly, the driven roller 51*a* of the cutter housing 51 moves on the upper guide rail 61 along the forward path during cutting of the rolled sheet 30, and on the lower guide rail 62 along the backward path after cutting of the rolled sheet 30.

As illustrated in FIGS. 5A and 5B, the upper guide rail 61 has a drive-roller guide area 61*a* and a driven-roller guide area 61*b* arranged side by side in the sheet feed direction B. The drive-roller guide area 61*a* is an area in which the upper guide rail 61 guides the drive roller 55 in the sheet width direction. The driven-roller guide area 61*b* is an area in which the upper guide rail 61 guides the driven roller 51*a* so that the cutter housing 51 moves along the forward path.

Figure 7:
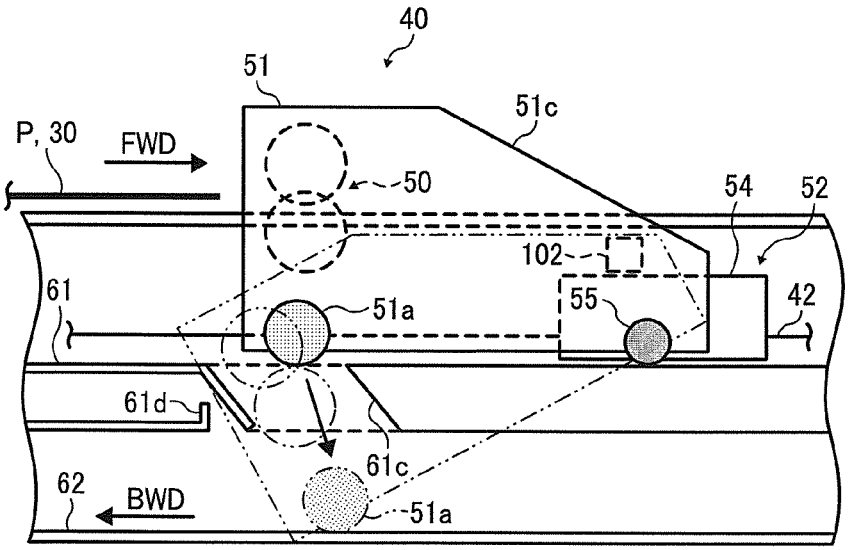
FIG. 7 is a schematic view of the cutter housing shifting to a backward path.

At the front left side of the driven-roller guide area 61*b* in the sheet width direction, a first communication path 61*c* is formed to switch the moving path of the cutter housing 51 from the forward path to the backward path. As illustrated in FIG. 7, the first communication path 61*c* is formed at the upper guide rail 61 so as to communicate the forward path (indicated by arrow FWD) on the upper guide rail 61 with the backward path (indicated by arrow BWD) on the lower guide rail 62.

Specifically, a predetermined portion of the upper guide rail 61 is cut out at the front left side of the apparatus body 1*a* in the sheet width direction and folded so as to slant downward at a certain angle, thus forming the first communication path 61*c*.

Thus, the first communication path 61*c* allows the driven roller 51*a* to move from the upper guide rail 61 to the lower guide rail 62 after the rolled sheet is cut with the cutter 50. A lower end portion 61*d* of the upper guide rail 61 adjacent to the first communication path 61*c* is folded upward so as not to contact the driven roller 51*a* moving along the backward path.

Figure 6:
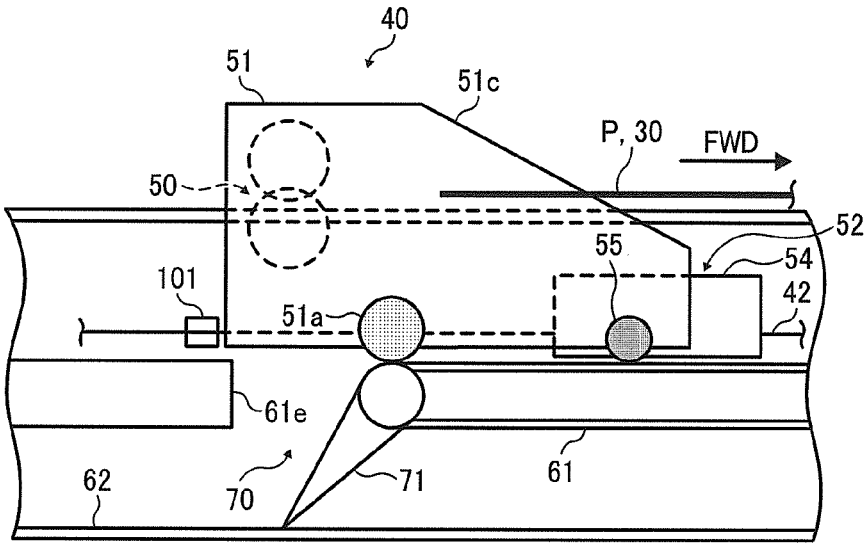
FIG. 6 is a schematic view of a cutter housing of the sheet cutting device having returned to a rolled-sheet cutting area.

As illustrated in FIG. 6, a moving assembly 70 is disposed at the front right side of the driven-roller guide area 61*b* opposite the first end side in the sheet width direction. When the cutter housing 51 moves from the home position indicated by solid line of FIG. 11 to the front left side of the apparatus body 1*a* in the sheet width direction, the moving assembly 70 moves the driven roller 51*a* from the lower guide rail 62 to the upper guide rail 61. In other words, the moving assembly 70 returns the cutter housing 51 to an area (hereinafter, rolled-sheet cutting operation area) in which the cutting operation of the rolled sheet 30 is performed.

The moving assembly 70 includes a second communication path 61*e* to communicate the backward path on the lower guide rail 62 with the forward path on the upper guide rail 61, and a switching hook 71 disposed adjacent to the second communication path 61*e* at the upper guide rail 61.

The second communication path 61*e* is fouled by cutting out a predetermined portion of the upper guide rail 61 at the front right side of the apparatus body 1*a* in the sheet width direction (see FIG. 5B).

The switching hook 71 is pivotable between the backward path and the second communication path 61*e*, that is, can circulate forward and in reverse within a predetermined angle range. The switching hook 71 is constantly urged downward by an elastic member, e.g., a coil spring, so that a tip of the switching hook 71 contacts the lower guide rail 62.

Figure 10:
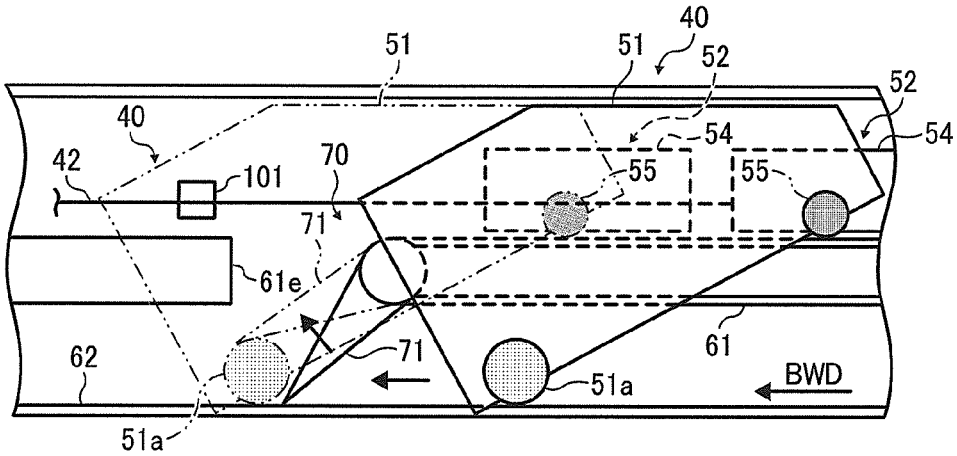
FIG. 10 is an illustration of the cutter housing of the sheet cutting device in an operation to return from the backward path to a home position.

As a result, as illustrated in FIG. 10, when the cutter housing 51 moves along the backward path (indicated by arrow BWD) to the front right side of the apparatus body 1*a* in the sheet width direction, the driven roller 51*a* contacts the switching hook 71 to pivot the switching hook 71 upward against an elastic force of the elastic member as indicated by broken line in FIG. 10.

From this state, when the driven roller 51*a* further moves to the front right side of the apparatus body 1*a* in the sheet width direction, the switching hook 71 is detached from the driven roller 51*a* and returned by the elastic force of the elastic member to an initial position, that is, a position indicated by solid line in FIG. 10.

Figure 11:
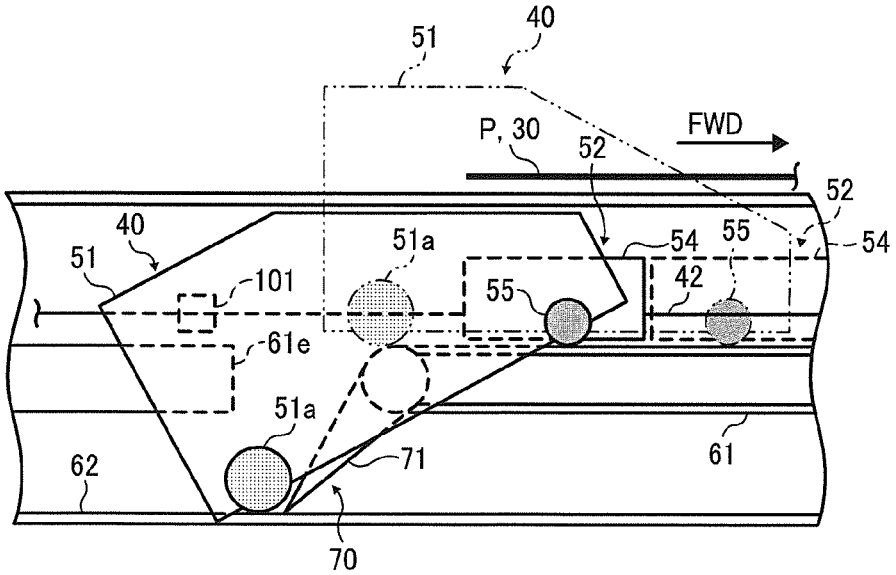
FIG. 11 is an illustration of the cutter housing of the sheet cutting device having returned to the rolled-sheet cutting area.

At the initial position indicated by solid line in FIG. 10, the switching hook 71 is tilted at a predetermined angle. Thus, as illustrated in FIG. 11, when the cutter housing 51 returns from the backward path to the forward path, the driven roller 51*a* can be moved from the lower guide rail 62 to the upper guide rail 61 via the switching hook 71. The switching hook 71 may be, for example, a flat spring. Such a configuration obviates the elastic member.

The lower guide rail 62 guides the driven roller 51*a* of the cutter housing 51 while the cutter housing 51 moves along the backward path.

As illustrated in FIG. 5A, the upper guide plate 63 includes a first guide face 63*a* and a second guide face 63*b* disposed opposite a pair of side plates 52*a* and 52*b*, respectively, of the mover 52.

The first guide face 63*a* is folded downward in L-shape relative to the upper guide plate 63 and integrally connected to the upper guide rail 61. In this embodiment, the upper guide plate 63 and the upper guide rail 61 integrally molded via the first guide face 63*a*. In some embodiments, the upper guide plate 63 and the upper guide rail 61 may be separate members.

Like the first guide face 63*a*, the second guide face 63*b* is folded downward in L-shape relative to the upper guide plate 63 and extends downward by a predetermined length. Here, the predetermined length by which the second guide face 63*b* extends is a length enough to obtain a contactable region of each of contact portions 54*d* of the mover 52.

Next, operation of the sheet cutting device 5 is described with reference to FIGS. 6 to 11.

As illustrated in FIG. 11, before the rolled sheet 30 is cut, the cutter housing 51 is placed at the cutter home position (indicated by solid line in FIG. 11) at the front right side of the apparatus body 1*a* in the sheet width direction. At this time, the first detector 101 is turned on, thus allowing detection of the cutter housing 51 at the cutter home position.

When the controller 100 receives an instruction for sheet cutting, the drive roller 55 is rotated via the wire 55 (see FIG. 4) to move the cutter housing 51. Accordingly, the cutter housing 51 performs a cutting preparation operation to rotate and move from the cutter home position to the rolled-sheet cutting operation area (a position indicated by broken line in FIG. 11), and the first detector 101 is turned off. Then, the cutter housing 51 moves on the forward path to the front left side of the apparatus body 1*a* in the sheet width direction. At this time, the cutter 50 cuts the rolled sheet 30 with the movement of the cutter housing 51.

As illustrated in FIG. 7, when the cutter housing 51 moves along the forward path (indicated by arrow FWD) to the front left side of the apparatus body 1*a* in the sheet width direction across the sheet feed path (indicated by solid line P), the second detector 102 is turned on. Thus, by detecting the cutter housing 51 with the second detector 102, it is detected that the cutter housing 51 is placed at the second retracted position, and the cutting of the rolled sheet 30 ends.

After the cutter housing 51 moves to the front left side of the apparatus body 1*a* in the sheet width direction, the cutter housing 51 pivots downward in the vertical direction around the rotation shaft 53 of the drive roller 55 (see FIG. 5A) under its own weight to switch the moving path from the forward path to the backward path.

For example, when the driven roller 51*a* moving on the upper guide rail 61 arrives at the first communication path 61*c*, the driven roller 51*a* moves from the upper guide rail 61 to the lower guide rail 62 via the first communication path 61*c*.

Figure 8:
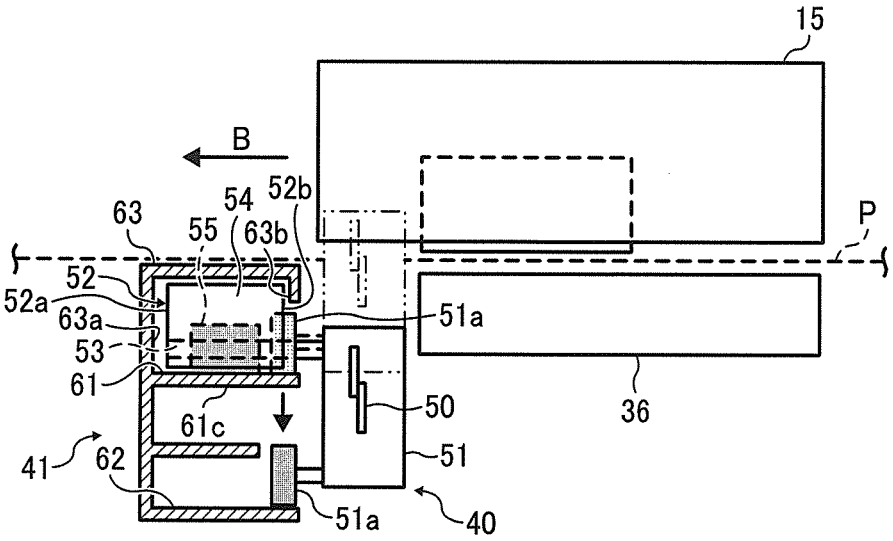
FIG. 8 is a partially cross-sectional side view of the cutter housing shifting to the backward path.

At this time, as illustrated in FIG. 8, with the drive roller 55 retained on the upper guide rail 61, only the driven roller 51*a* moves to the lower guide rail 62 under its own weight.

As a result, in FIG. 7, the cutter housing 51 overlapping with the sheet feed path indicated by broken line P pivots to take a position with which the cutter housing 51 is movable along the backward path, that is, the position (indicated by broken line in FIG. 7) with which the cutter housing 51 is retracted from the sheet feed path P.

Figure 9:
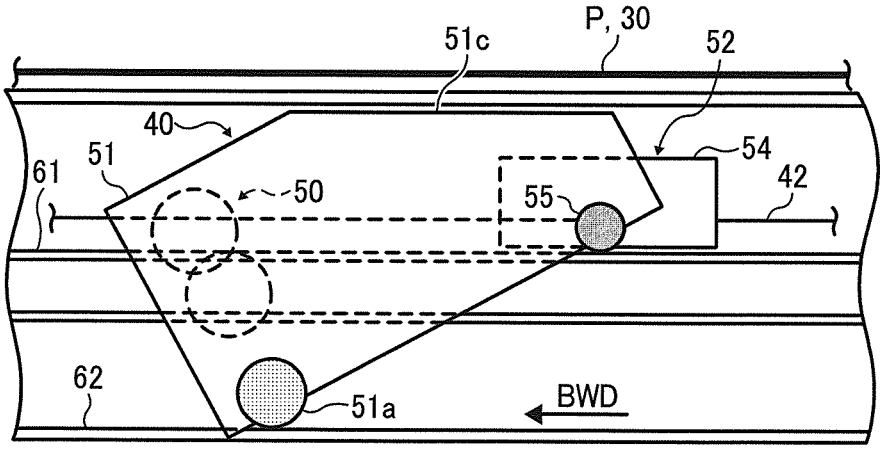
FIG. 9 is an illustration of the cutter housing moving on the backward path.

Then, the wire 42 (see FIG. 4) is circulated in reverse to rotate the drive roller 55 in reverse, that is, in a direction opposite a direction in which the drive roller 55 rotates to move on the forward path. Thus, as illustrated in FIG. 9, with the position retracted from the sheet feed path P, the cutter housing 51 moves along the backward path (indicated by arrow BWD) to the front right side of the apparatus body 1*a* in the sheet width direction.

At this time, when the cutter housing 51 starts to move, the second detector 102 is turned off. At this time, the slanted face 51*c* is parallel to the sheet feed path P and, unlike on the forward path, the cutter housing 51 is retracted downward from the sheet feed path P.

Thus, while the cutter housing 51 moves along the backward path, the rolled sheet 30 can be fed along the sheet feed path P, thus allowing start of the next image formation and enhancing productivity. Such a configuration can also prevent the cutter 50 from contacting the rolled sheet 30 after cutting, thus preventing a cut jam or other failure.

As illustrated in FIG. 10, when the cutter housing 51 moves to the front right side of the apparatus body 1*a* in the sheet width direction and arrives at a position adjacent to the moving assembly 70, the driven roller 51*a* contacts the switching hook 71. With the movement of the cutter housing 51, the driven roller 51*a* pushes up the switching hook 71 as indicated by broken line in FIG. 9 and moves from the backward path side (the right side of the switching hook 71 in FIG. 10) to the front right side of the apparatus body 1*a* in the sheet width direction, that is, the side of the second communication path 61*e* (the left side of the switching hook 71 in FIG. 10).

When the driven roller 51*a* moves to the side of the second communication path 61*e*, the switching hook 71 is detached from the driven roller 51*a* and returned by the elastic force of the elastic member to the initial position, that is, the position indicated by solid line in FIG. 10. At this time, the first detector 101 is turned on, thus allowing detection of the cutter housing 51 at the cutter home position.

Thus, the reciprocal movement of the cutter housing 51 in the sheet width direction is finished. If the rolled sheet 30 is subsequently fed, the above-described reciprocal movement is repeated.

Next, the cutter housing 51 and the mover 52 according to this embodiment are further described with reference to FIGS. 12 to 15.

Figure 12A:
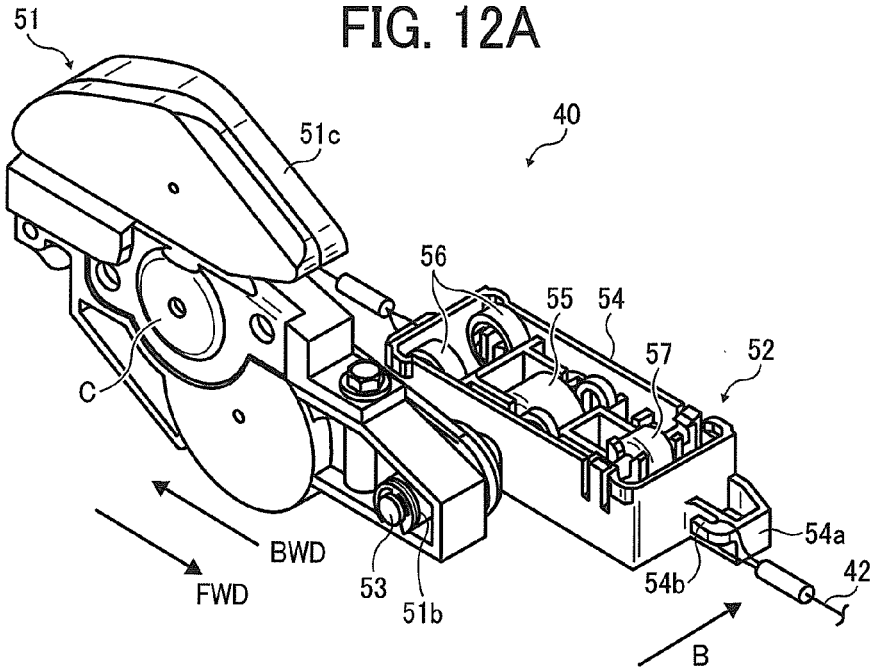
FIG. 12A is a perspective view of a cutter unit according to an embodiment of the present disclosure, seen from the back side.
Figure 12B:
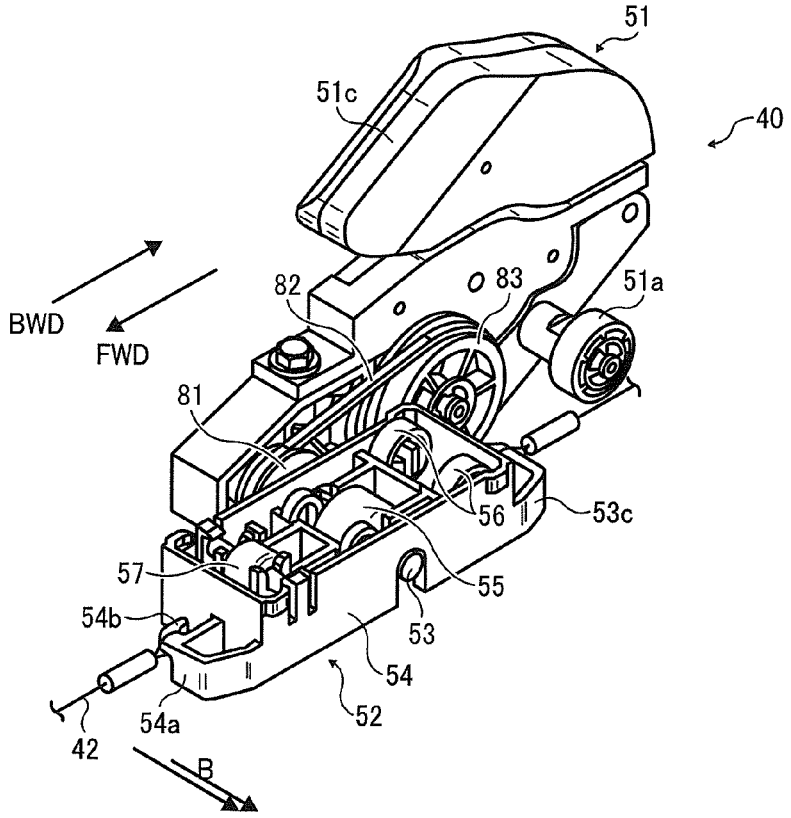
FIG. 12B is a perspective view of the cutter unit seen from the front side.
Figure 13:
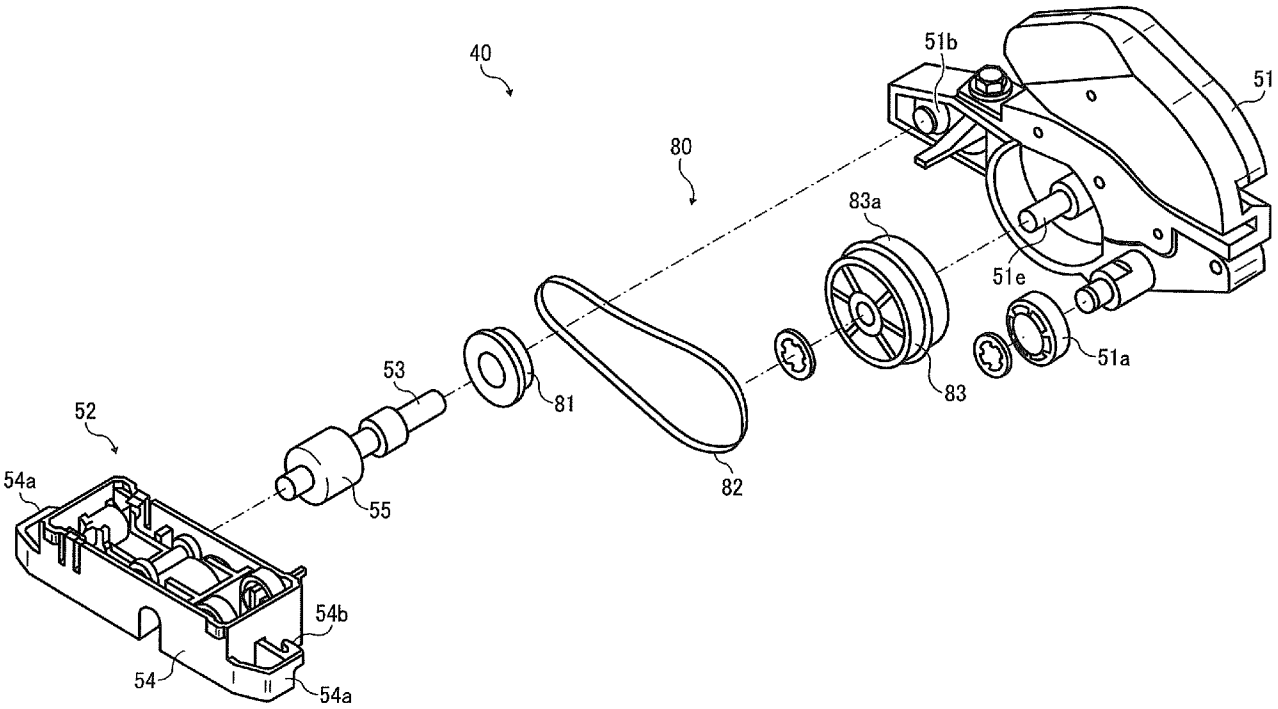
FIG. 13 is an exploded perspective view of the cutter unit of FIGS. 12A and 12B.

As illustrated in FIGS. 12A, 12B, and 13, the cutter housing 51 has the bearing 51*b* supporting the rotation shaft 53. The bearing 51*b* is disposed at a position downstream from an accommodated position C of the cutter 50 (see FIG. 14) in the cutting direction, i.e., the direction of movement of the cutter housing 51 (along the forward path indicated by FWD in FIG. 12A) and lower than the accommodated position C. The cutter housing 51 is rotatably coupled with the rotation shaft 53 via the bearing 51*b*.

Figure 14:
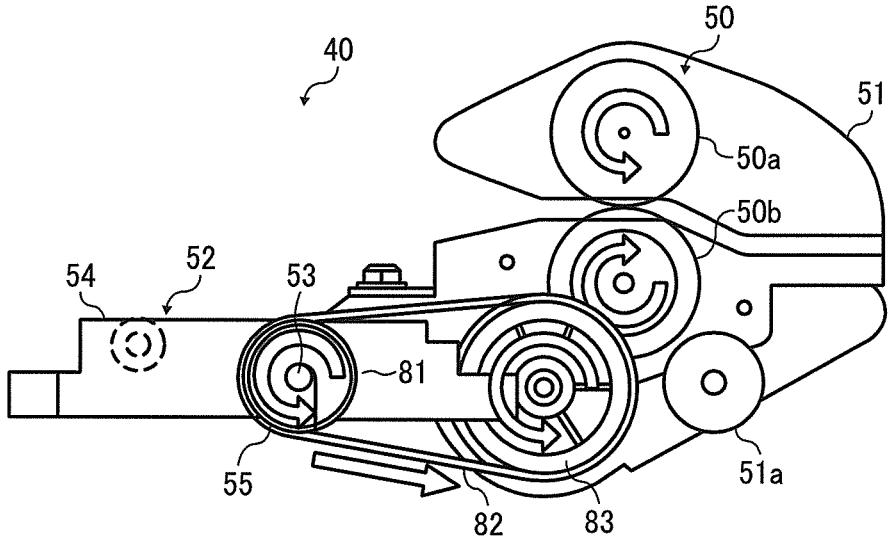
FIG. 14 is an illustration of a structure of transmitting a rotational drive force of a drive roller according to an embodiment of the present disclosure.

The cutter housing 51 includes a transmitter 80 to transmit a rotational drive force to the cutter 50 (see FIG. 14). The transmitter 80 includes a pulley 81, an endless belt 82, and a pulley 83.

The pulley 81 is mounted to the rotation shaft 53 so that the pulley 81 is rotatable with the rotation shaft 53. The pulley 83 is rotatably mounted to a shaft 51*e* of the cutter housing 51. Here, a gear portion 83*a* to engage a gear inside the cutter housing 51 is disposed on an upstream side of the pulley 83 in the sheet feed direction.

Engagement of the gear portion 83*a* with the gear allows transmission of the rotational drive force to the cutter 50 (see FIG. 14). The endless belt 82 is wound around the pulley 81 and the pulley 83.

Accordingly, as illustrated in FIG. 14, with movement of the mover 52 in the sheet width direction, the drive roller 55 is rotated to transmit the rotation driving force to the cutter 50 via the rotation shaft 53, the pulley 81, the endless belt 82, and the pulley 83. Thus, the circular blades 50*a* and 50*b* are rotated.

Figure 15:
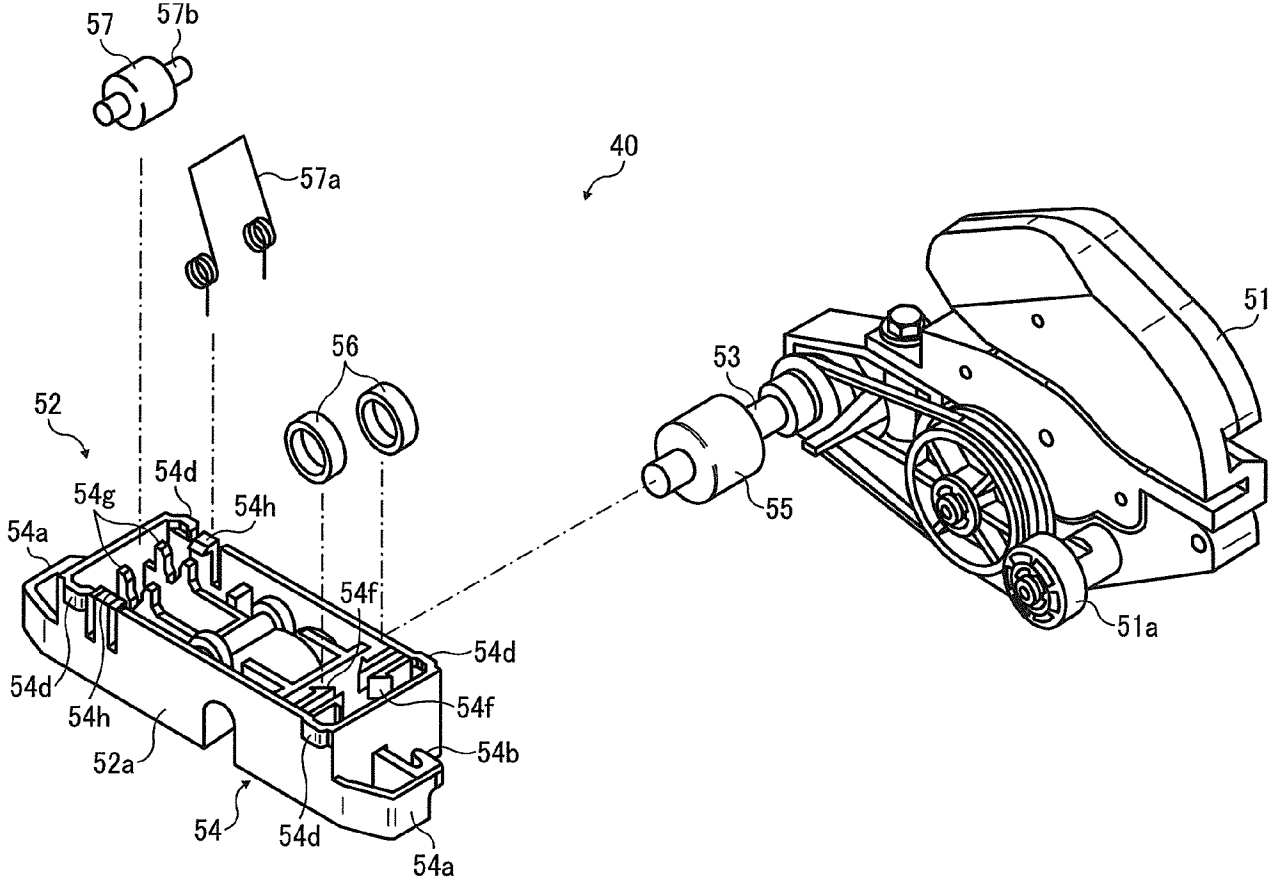
FIG. 15 is an exploded perspective view of a mover according to an embodiment of the present disclosure.

As illustrated in FIGS. 12A, 12B, and 15, the mover 52 includes the body 54, the drive roller 55, auxiliary rollers 56, a pressing roller 57, and an elastic member 57*a*.

The body 54 rotatably supports the rotation shaft 53, thus rotatably holding the drive roller 55. The rotation shaft 53 is rotatably mounted to the bearing 51*b* of the cutter housing 51. The body 54 of the mover 52 is disposed between the upper guide rail 61 and the upper guide plate 63 (see FIGS. 5A and 5B) to be movable in the sheet width direction.

As illustrated in FIG. 15, a projecting portion 54*a* is disposed at each of an upstream end and a downstream end of the body 54 in the cutting direction (both ends of the body 54 in the sheet width direction). The projecting portion 54*a* shares one side face with the body 54 and projects to each of an upstream side and a downstream side in the cutting direction. The projecting portion 54*a* includes a hook portion 54*b* to which the wire 42 is hooked.

In this embodiment, the hook portion 54*b* is disposed at the projecting portion 54*a*. In some embodiments, for example, the hook portion 54*b* may be directly disposed at the body 54. Alternatively, the wire 42 may be directly mounted to the body 54.

The body 54 has the contact portions 54*d* projecting outward at four upper positions of the side plates 52*a* and 52*b* disposed opposite the first guide face 63*a* and the second guide face 63*b*.

The contact portions 54*d* contacts the first guide face 63*a* and the second guide face 63*b*. The drive roller 55 is disposed at an upstream side of the body 54 in the cutting direction, that is, at a side closer to the auxiliary rollers 56 to rotate in contact with an upper face of the upper guide rail 61.

As illustrated in FIG. 15, the auxiliary rollers 56 are rotatably mounted to a pair of snap-fit portions 54*f*. The pair of snap-fit portions 54*f* is disposed opposite each other in the sheet feed direction at an upper portion on an upstream side of the body 54 in the cutting direction.

The pressing roller 57 has a roller shaft 57*b* and is rotatably mounted to bearing portions 54*g* that are disposed at an upper portion on a downstream side of the body 54 in the cutting direction. The roller shaft 57*b* is held to be movable upward and downward in the bearing portions 54*g*. The body 54 includes stopper portions 54*h* at inner positions than the side plates 52*a* and 52*b* in the sheet feed direction, to restrict the upward movement of the roller shaft 57*b* within a predetermined range.

The elastic member 57*a* is, for example, a double-torsion coil spring having one end secured to the body 54 and another end (a free end) to contact the roller shaft 57*b* of the pressing roller 57 from below the roller shaft 57*b*.

Accordingly, the elastic member 57*a* pushes the roller shaft 57*b* upward by the elastic force, thus pressing the pressing roller 57 against a lower face of the upper guide plate 63. In this embodiment, the auxiliary rollers 56 are disposed at the upstream side of the body 54 in the cutting direction and the pressing roller 57 is disposed at the downstream side of the body 54 in the cutting direction. In some embodiments, the arrangement of the auxiliary rollers 56 and the pressing roller 57 may be reversed.

The auxiliary rollers 56 and the pressing roller 57 rotate while contacting the lower face of the upper guide plate 63. Here, the auxiliary rollers 56 and the pressing roller 57 are disposed away from each other via the drive roller 55 in the sheet width direction (the lateral direction in FIG. 14).

Next, a configuration of the controller 100 is described with reference to FIG. 16.

As illustrated in FIG. 16, the first detector 101, the second detector 102, the encoder sensor 103, the recording heads 15*a*, the cap elevating unit 19*c*, the suction units 19*d*, the driving unit 38, the cutter-unit drive motor 59, an operation-and-display unit 105, an external device 150, and the carriage driving motor 21 are connected to the controller 100.

The controller 100 includes a micro computer including, for example, a central processing unit (CPU), a random access memory (RAM), a read-only memory (ROM), and an input-output interface, to control movement of the cutter unit 40 and the carriage unit 15.

The first detector 101 is disposed at a side of the first retracted position (left end in FIG. 17) in the cutter movement range R2 to detect the cutter housing 51 at the first retracted position.

The second detector 102 is disposed at a side of the second retracted position (right end in FIG. 17) in the cutter movement range R2 to detect the cutter housing 51 at the second retracted position.

As described above, the encoder sensor 103 is mounted to the carriage unit 15 to read the encoder sheet 16 to detect the main scanning position of the carriage unit 15. Signals representing detection results of the first detector 101, the second detector 102, and the encoder sensor 103 are input to the controller 100.

The operation-and-display unit 105 is disposed at the apparatus body 1*a* (see FIG. 1) to receive instructions of operation requests from a user or signals indicating continuation and discontinuation of print operation on detection of an abnormality of the cutter unit 40 and to display messages, such as error messages.

The controller 100 creates data for recording a desired image on the rolled sheet 30 in accordance with image information transferred from, e.g., the external device 150 connected to the controller 100 from the outside of the inkjet recording apparatus 1, outputs the data to the recording heads 15*a*, and controls driving of the recording heads 15*a*. The controller 100 also controls the carriage driving motor 21 and the driving unit 38, as well as the recording heads 15*a*. As described above, the controller 100 controls the recording heads 15*a*, the carriage driving motor 21, and the driving unit 38 to discharge ink droplets at proper timings to record a desired image on a recording area of the rolled sheet 30.

The controller 100 determines, based on an input signal from the encoder sensor 103, whether the carriage unit 15 is at the carriage home position or the dummy discharge position.

Through control of driving of the cutter-unit drive motor 59, the controller 100 conducts the sheet cutting operation to move the cutter housing 51 (see FIG. 4) to the front left side of the apparatus body 1*a* in the sheet width direction via the forward path FWD. Thus, the rolled sheet 30 (see FIG. 3) is cut by the above-described sheet cutting operation.

When the cutter housing 51 is detected with the second detector 102 after the sheet cutting operation, the controller 100 causes the cutter-unit drive motor 59 to rotate in reverse. Accordingly, the controller 100 causes the cutter housing 51 to move on the backward path to the front right side of the apparatus body 1*a* in the sheet width direction in the state in which the cutter housing 51 is retracted from the sheet feed path P.

At this time, the controller 100 controls the driving unit 38 so that the rolled sheet 30 (see FIG. 3) can be fed to the downstream side in the sheet feed direction while the cutter housing 51 moves along the backward path BWD. Thus, while the cutter housing 51 moves along the backward path, the rolled sheet 30 can be fed for, e.g., image recording.

The controller 100 is configured to control the carriage unit 15 and the cutter unit 40 so that the carriage unit 15 and the cutter unit 40 are overlappingly movable when a sheet cut position of the rolled sheet 30 (see FIG. 3) arrives at a cutter position on the moving path of the cutter 50. The cutter position corresponds to a sheet cutting position in this embodiment, and the sheet cut position of the rolled sheet 30 is a cut position in this embodiment.

Here, when the controller 100 overlappingly moves the carriage unit 15 and the cutter unit 40, the direction of movement of the carriage unit 15 is the same as the direction of movement (cutting direction) of the cutter unit 40 during cutting of the rolled sheet 30. Further, for example, when the carriage unit 15 moves to the dummy discharge position after finishing printing at the right side of the maximum sheet width in FIG. 17, or when the carriage unit 15 moves from the left side to the right side of the maximum sheet width in FIG. 17 on arrival of the sheet cut position of the rolled sheet 30 at the cutter position, the controller 100 overlappingly moves the carriage unit 15 and the cutter unit 40.

The controller 100 is configured so that the direction of movement of the carriage unit 15 is the same as the direction of movement of the cutter unit 40 in an image recording condition for consecutively recording images of a plurality of pages on the rolled sheet 30.

Next, an example of the control to overlappingly move the carriage unit 15 and the cutter unit 40 is described with reference to FIGS. 18 to 20.

Since the condition in which the carriage unit 15 and the cutter unit 40 are overlappingly movable is quite limited, the direction of movement of the carriage unit 15 is not always the same as the direction of movement of the cutter unit 40 at the sheet cut position of the rolled sheet 30 in a print mode (normal high-speed mode) in which productivity is most prioritized.

Hence, it is conceivable to control determine the number of times of movement of the carriage unit 15 from a distance at which a second sheet is printed in a time period from the end of printing of a first sheet to a cutting position of the first sheet and always match the direction of movement of the carriage unit 15 with the direction of movement of the cutter unit 40 at the sheet cut position.

Figure 18:
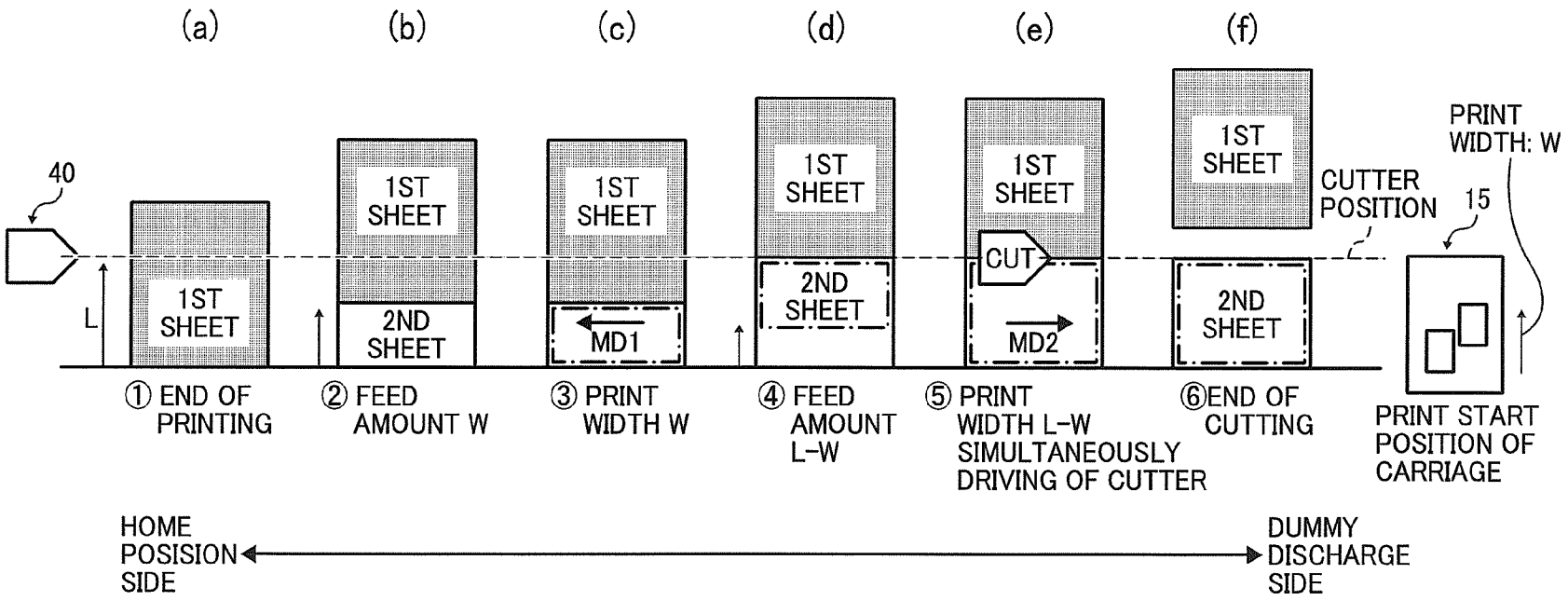
FIG. 18 is an illustration of a positional relationship between sheet cut position and cutter position according to an embodiment of the present disclosure.
Figure 19:
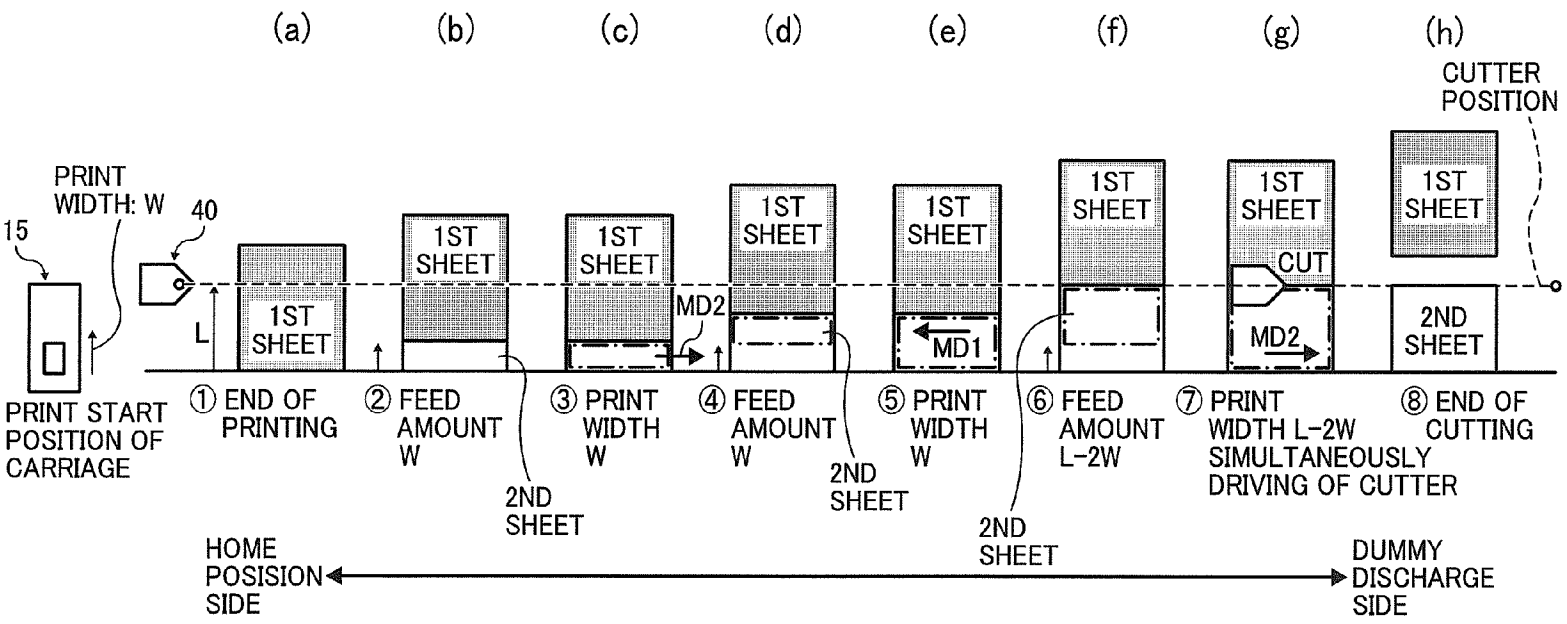
FIG. 19 is an illustration of a positional relationship between sheet cut position and cutter position according to an embodiment of the present disclosure.

For example, as illustrated in FIGS. 18 and 19, the controller 100 controls a direction of start of writing at a page head to be rightward or leftward in accordance with the number of times of movement of the carriage unit 15 to be performed by when the sheet cut position of the rolled sheet 30 arrives at the cutter position.

FIG. 18 is an illustration of a control performed when the number of times of movement of the carriage unit 15 to be performed by when the sheet cut position of the rolled sheet 30 arrives at the cutter position is twice (even number). L represents a distance from the sheet cut position of a first sheet to the cutter position. W represents a print width of the carriage unit 15. The cutter unit 40 cuts the rolled sheet 30 while moving from the carriage home position side to the dummy discharge side.

When the printing of the first sheet ends ((a) of FIG. 18), the rolled sheet 30 is fed downstream in the sheet feed direction by the print width W ((b) of FIG. 18). Next, the carriage unit 15 moves in a direction indicated by arrow MD1 from the left side (the dummy discharge side) to the right side (the carriage home position side), seen from the front side of the apparatus body 1*a*, to perform print operation ((c) of FIG. 18).

When the first print operation ends, the rolled sheet 30 is fed downstream in the sheet feed direction by a remaining distance of L−W required for the printing of a second sheet ((d) of FIG. 18) and the sheet cut position of the rolled sheet 30 arrives at the cutter position. Next, the carriage unit 15, which having stood by at the carriage home position side, moves in a direction indicated by arrow MD2 from the right side (the carriage home position side) to the left side (the dummy discharge side), seen from the front side of the apparatus body 1*a*, to perform print operation ((e) of FIG. 18). At this time, the cutter unit 40 performs cutting operation while moving in the same direction as the direction of movement of the carriage unit 15 ((f) of FIG. 18).

As described above, when the number of times of movement of the carriage unit 15 is twice (even number), the writing direction of the carriage unit 15 and the cutting direction of the cutter unit 40 are controlled to be opposite each other, in other words, the direction of movement of the carriage unit 15 in a leading end of the second sheet is controlled to be the direction MD1 from the left side (the dummy discharge side) to the right side (the carriage home position side). Accordingly, the direction of movement of the cutter unit 40 is the same as the direction of movement of the carriage unit 15, thus allows overlapping movement of the cutter unit 40 and the carriage unit 15.

FIG. 19 is an illustration of a control performed when the number of times of movement of the carriage unit 15 to be performed by when the sheet cut position of the rolled sheet 30 arrives at the cutter position is three times (odd number). L represents a distance from the sheet cut position of a first sheet to the cutter position. W represents a print width of the carriage unit 15. The cutter unit 40 cuts the rolled sheet 30 while moving from the carriage home position side to the dummy discharge side.

When the printing of the first sheet ends ((a) of FIG. 19), the rolled sheet 30 is fed downstream in the sheet feed direction by the print width W ((b) of FIG. 19). Next, the carriage unit 15 moves in the direction indicated by arrow MD2 from the right side (the carriage home position side) to the left side (the dummy discharge side), seen from the front side of the apparatus body 1*a*, to perform print operation ((c) of FIG. 19). When the first print operation of a first sheet ends, the rolled sheet 30 is fed downstream in the sheet feed direction by the print width W ((d) of FIG. 19).

Next, the carriage unit 15, which having stood by at the dummy discharge side, moves in the direction indicated by arrow MD1 from the left side (the dummy discharge side) to the right side (the carriage home position side), seen from the front side of the apparatus body 1*a*, to perform print operation ((e) of FIG. 19). When the second print operation of the first sheet ends, the rolled sheet 30 is fed downstream in the sheet feed direction by a remaining distance of L−2W required for the printing of a second sheet ((f) of FIG. 19).

Thus, the carriage unit 15, which having stood by at the carriage home position side, moves in a direction indicated by arrow MD2 from the right side (the carriage home position side) to the left side (the dummy discharge side), seen from the front side of the apparatus body 1*a*, to perform print operation ((g) of FIG. 19). At this time, the cutter unit 40 performs cutting operation while moving in the same direction as the direction of movement of the carriage unit 15 ((h) of FIG. 19).

As described above, when the number of times of movement of the carriage unit 15 is three times (odd number), the writing direction of the carriage unit 15 and the cutting direction of the cutter unit 40 are controlled to be the same, in other words, the direction of movement of the carriage unit 15 in a leading end of the second sheet is controlled to be the direction MD2 from the right side (the carriage home position side) to the left side (the dummy discharge side). Accordingly, the direction of movement of the cutter unit 40 is the same as the direction of movement of the carriage unit 15, thus allows overlapping movement of the cutter unit 40 and the carriage unit 15.

In the above description, with reference to FIGS. 18 and 19, the number of times of movement of the carriage unit 15 to be performed by when the sheet cut position of the rolled sheet 30 arrives at the cutter position is twice and third times, respectively. Further, more generally, the case in which the number of times of movement of the carriage unit 15 is N times is described with reference to FIG. 20.

Figure 20:
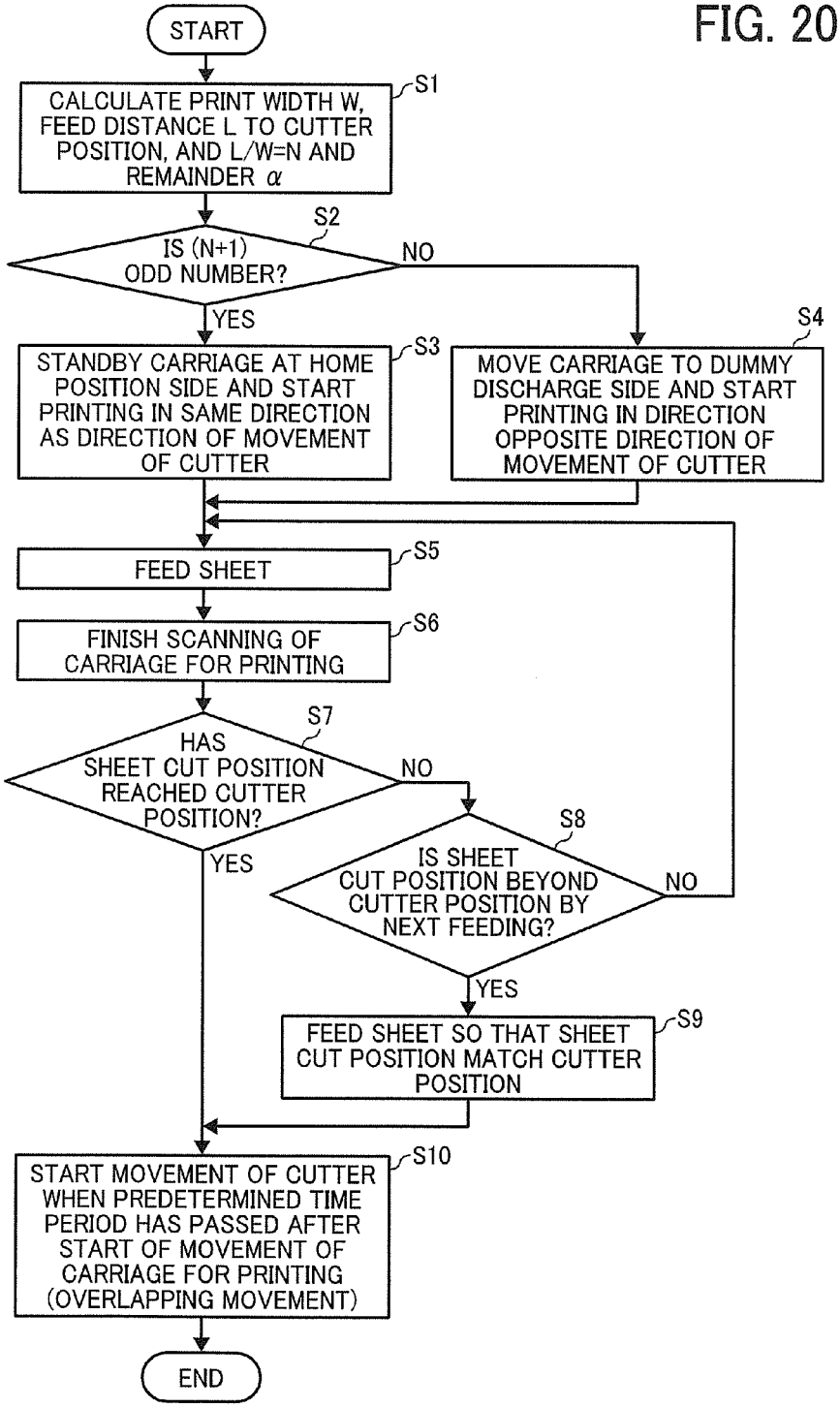
FIG. 20 is a flow chart of image recording control and movement control of the cutter unit performed by a controller according to an embodiment of the present disclosure.

As illustrated in FIG. 20, W represents a print width in which the carriage unit 15 can print in the sheet feed direction by a single movement, and L represents a distance in which the rolled sheet 30 is fed by when the sheet cut position arrives at the cutter position, that is, a feed distance in which the rolled sheet 30 is fed by when a trailing end of a preceding page moves from a print end position for the trailing end to the cutter position in a mode for forming an image by one pass (single scanning). The direction of movement of the cutter unit 40 is from the right side (the carriage home position side) to the left side (the dummy discharge side), seen from the front side of the apparatus body 1*a*.

The controller 100 calculates N and $\alpha$ satisfying the following formula (step S1). Here, N is a positive integer and $\alpha$ is a value smaller than W. L/W=N remainder $\alpha$ At this time, before the trailing end of a first sheet arrives at the cutter position, print operation is performed on a second sheet by at least N+1 times of movement of the carriage unit 15 and likewise, the rolled sheet 30 is fed at least N+1 times. When the N+1 times of sheet feeding ends, the sheet cut position of the first sheet arrives at the cutter position. After the N+1 times of movement of the carriage unit 15 ends, the cutting operation is performed.

At this time, if the direction of movement of the carriage unit 15 at the N+1 times is the same as the direction of movement of the cutter unit 40, the carriage unit 15 and the cutter unit 40 is overlappingly movable.

Next, the controller 100 determines whether the value of N+1 calculated at step S1 is odd number (step S2).

When N+1 is odd (YES at S2), the controller 100 causes the carriage unit 15 to stand by at the home position side and perform writing print operation from the right side to the left side, seen from the front side of the apparatus body 1*a*, that is, in the same direction as the direction of movement of the cutter unit 40 (step S3).

When N+1 is even (No at S2), the controller 100 causes the carriage unit 15 to move to the dummy discharge side and perform writing print operation from the left side to the right side, seen from the front side of the apparatus body 1*a*, that is, in the opposite direction to the direction of movement of the cutter unit 40 (step S3).

After the cutter unit 40 starts print operation at S3 or S4, the controller 100 feeds the rolled sheet 30 by a distance of the print width W (step S5).

When the scanning of the carriage unit 15 for printing is finished (step S6), the controller 100 determines whether the sheet cut position of the rolled sheet 30 arrives at the cutter position (step S7). For example, after the printing on the first sheet ends as illustrated in (d) of FIG. 18), the controller 100 determines whether the sheet cut position matches the cutter position.

When the controller 100 determines that the sheet cut position does not match the cutter position (NO at S7), the controller 100 determines whether the sheet cut position of the rolled sheet 30 goes beyond the cutter position by the next feeding (step S8).

When the controller 100 determines that the sheet cut position does not go beyond the cutter position by the next feeding (NO at S8), the process returns to step S5 and the controller 100 feeds the rolled sheet 30 to the next print position. Then, the controller 100 performs scanning of the carriage unit 15 for printing the next recording line (step S6).

By contrast, when the controller 100 determines that the sheet cut position goes beyond the cutter position by the next feeding, the controller 100 feeds the rolled sheet 30 so that the sheet cut position matches the cutter position (step S9), and the process goes to step S10.

When the controller 100 determines that the sheet cut position has reached the cutter position (YES at S7), the controller 100 starts movement of the cutter unit 40 after a predetermined time period has passed from the start of movement of the carriage unit 15 for printing (step S10). At this time, the carriage unit 15 and the cutter unit 40 overlappingly move.

In the case in which the direction of movement of the cutter unit 40 is from the right side (the carriage home position side) to the left side (the dummy discharge side), seen from the front side of the apparatus body 1*a*, the above-described control causes the direction of movement of the carriage unit 15 on the leading end of the second sheet to be from the right side to the left side when N+1 is odd and from the left side to the right side when N+1 is even. Accordingly, the direction of movement of the cutter unit 40 and the direction of movement of the carriage unit 15 are always the same, thus allowing the cutter unit 40 and the carriage unit 15 to overlappingly move.

Likewise, in the case in which the direction of operation of the cutter unit 40 is opposite (i.e., from the left side to the right side), the direction of movement of the carriage unit 15 on the leading end of the second sheet is from the left side to the right side when N+1 is odd and from the right side to the left side when N+1 is even. Here, to change the direction of movement of the carriage unit 15 on the leading end of the second sheet, for example, the controller 100 calculates, from the sheet size and the print mode, the number of movement of the carriage unit 15 to be performed by when the sheet cut position arrives at the cutter position. After the carriage unit 15 moves in a predetermined direction at a print start position on the leading end of the sheet, the controller 100 starts printing.

Alternatively, since the feed distance to the cutter position is constant in the apparatus, the movement start position on the leading end of the sheet may be controlled based on a predetermined writing direction of the carriage unit 15 in accordance with the print mode.

As described above, for the inkjet recording apparatus 1 according to this embodiment, when the sheet cut position of the rolled sheet 30 arrives at the cutter position, the direction of movement of the carriage unit 15 is the same as the direction of movement of the cutter unit 40, thus allows the movement of the carriage unit 15 and the movement of the cutter unit 40 to be overlappingly performed. For example, when the carriage unit 15 is on the left side of the rolled sheet 30 on arrival of the sheet cut position at the cutter position, the direction of movement of each of the carriage unit 15 moving toward the dummy discharge position and the cutter unit 40 moving for the sheet cutting operation is the cutting direction. Accordingly, after a predetermined time period (for example, 0.1 second) has passed from the start of movement of the carriage unit 15, the controller 100 causes the cutter unit 40 to move in the cutting direction to perform the sheet cutting operation. In other words, the movement of the carriage unit 15 and the movement of the cutter unit 40 are overlappingly performed.

Accordingly, the inkjet recording apparatus 1 according to this embodiment does not always restrict the movement of the carriage unit 15 during the sheet cutting operation. Therefore, for example, even in a time period to retract the carriage unit 15 to the dummy discharge position, the inkjet recording apparatus 1 can perform the sheet cutting operation, thus enhancing the productivity.

Alternatively, where L is the feed distance and W is the width of an image recordable in the sheet feed direction by a single movement of the carriage unit 15, the controller 100 may calculate a natural number N obtained from the formula: L/W=N remainder $\alpha$ and control the direction of movement of the carriage unit 15 on the leading end of a page to be the same as the direction of movement of the cutter unit 40 in the cutting operation when N+1 is odd and to be opposite when N+1 is even.

Accordingly, the direction of movement of the cutter unit 40 and the direction of movement of the carriage unit 15 are always the same, thus allowing the cutter unit 40 and the carriage unit 15 to overlappingly move.

In some embodiments, the sheet feed condition, carriage operation, and image forming condition of a first page of the rolled sheet 30 may be the same as those of subsequent pages. Such a configuration unifies the print conditions of multiple pages, thus preventing image failure due to uneven image qualities among pages.

In some embodiments, an image may be recorded on the rolled sheet 30 on the sheet feed path when the carriage unit 15 and the cutter unit 40 are overlappingly moved. Such a configuration allows the cutting operation and the print operation to be simultaneously performed, thus enhancing the productivity.

The cutter movement range and the carriage movement range during cutting of the rolled sheet 30 by the cutter unit 40 may be arranged to overlap with each other in the direction of thickness of the rolled sheet 30. In such a case, the cutter unit may be configured to be movable in the width direction of the sheet feed path in a state in which the cutter unit 40 is retracted from the sheet feed path in the direction of thickness of the rolled sheet 30.

Accordingly, even the configuration in which the movement range of the carriage unit 15 and the movement range of the cutter unit 40 overlap with each other, the cutter unit 40 can be returned to the initial position during operation of the carriage unit 15, thus enhancing the productivity.

As described above, the inkjet recording apparatus 1 according to this embodiment is configured to move the cutter unit 40 after a predetermined time period determined in consideration of a speed difference between the carriage unit 15 and the cutter unit 40 has passed from the start of movement of the carriage unit 15. Accordingly, even when the cutter unit 40 and the carriage unit 15 are overlappingly moved, the carriage unit 15 starts movement earlier than the cutter unit 40 and the cutter unit 40 does not catch up with the carriage unit 15. Such a configuration reliably prevents the cutter unit 40 from contacting the carriage unit 15.

With the controller 100 according to this embodiment, controlling the writing direction of the carriage unit 15 on the leading end of a sheet allows the direction of movement of the carriage unit 15 and the direction of movement of the cutter unit 40 to be the same on arrival of the sheet cut position at the cutter position. Such a configuration allows the carriage unit 15 and the cutter unit 40 to overlappingly move, thus reliably enhancing the productivity by the overlapping movement in a print mode (high-speed mode) prioritizing the productivity.

In a print mode to print an image of a width W by two movements of the carriage unit 15 on the forward path and the backward path, if the direction of movement of the cutter unit 40 is the same as the direction of printing of the carriage unit 15 on the forward path, the direction of movement of the cutter unit 40 is always the same as the direction of movement of the carriage unit 15 on arrival of the sheet cut position at the cutter position, thus allowing overlapping movement of the cutter unit 40 and the carriage unit 15.

By contrast, when the direction of movement of the cutter unit 40 is opposite the direction of printing of the carriage unit 15 on the forward path, the direction of movement of the carriage unit 15 on the leading end of a second sheet is usually controlled to be opposite the direction of printing on the forward path.

Here, the example of the direction of movement of the carriage unit 15 on the leading end of the second sheet is described. However, it is not limited to the printing on the second sheet but may be a third or subsequent sheet in continuous printing.

The direction of movement of the carriage unit 15 in printing the leading end of the first sheet is preferably the same as the direction of movement of the carriage unit 15 in printing the leading end of the second and subsequent sheets. This is because, if the direction of movement of the carriage unit 15 differs between pages, the landing order of colors of ink discharged from the carriage unit 15 changes, which might cause a change in image appearance.

In the above description, the configuration is described in which the cutter unit 40 is retractable from the carriage unit 15 in the sheet thickness direction or movable in the carriage movement direction at the retracted position. However, the configuration of the cutter unit 40 is not limited to the above-described configuration but may correspond to the configuration in which the range of movement of the carriage unit 15 and the range of movement of the cutter unit 40 overlap with each other.

Second embodiment Next, a second embodiment of the present disclosure is described with reference to FIGS. 21 and 22.

The second embodiment differs from the first embodiment in that the print width of the carriage unit 15 is controlled to change. Except for the difference, the second embodiment has the same configuration as the first embodiment. Accordingly, the same components are described with the same reference codes as those of the first embodiment illustrated in FIGS. 1 to 20. The difference is mainly described below.

In the first embodiment, the direction of movement of the carriage unit 15 is changed to match the direction of movement of the cutter unit 40 with the direction of movement of the carriage unit 15 on arrival of the sheet cut position at the cutter position. By contrast, in this embodiment, the print width in each carriage operation performed by when the sheet cut position arrives at the cutter position is adjusted without changing the direction of movement of the carriage unit 15.

Figure 21:
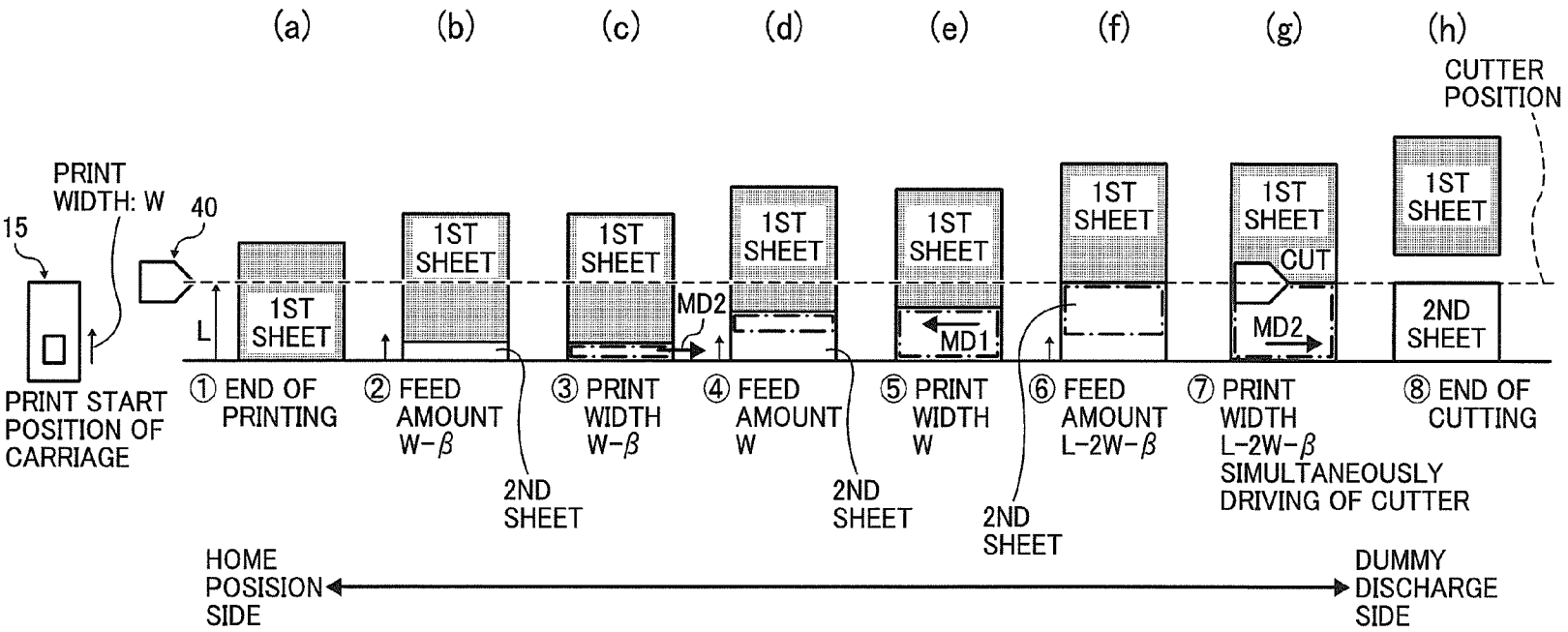
FIG. 21 is an illustration of a positional relationship between sheet cut position and cutter position according to a second embodiment of the present disclosure.
Figure 22:
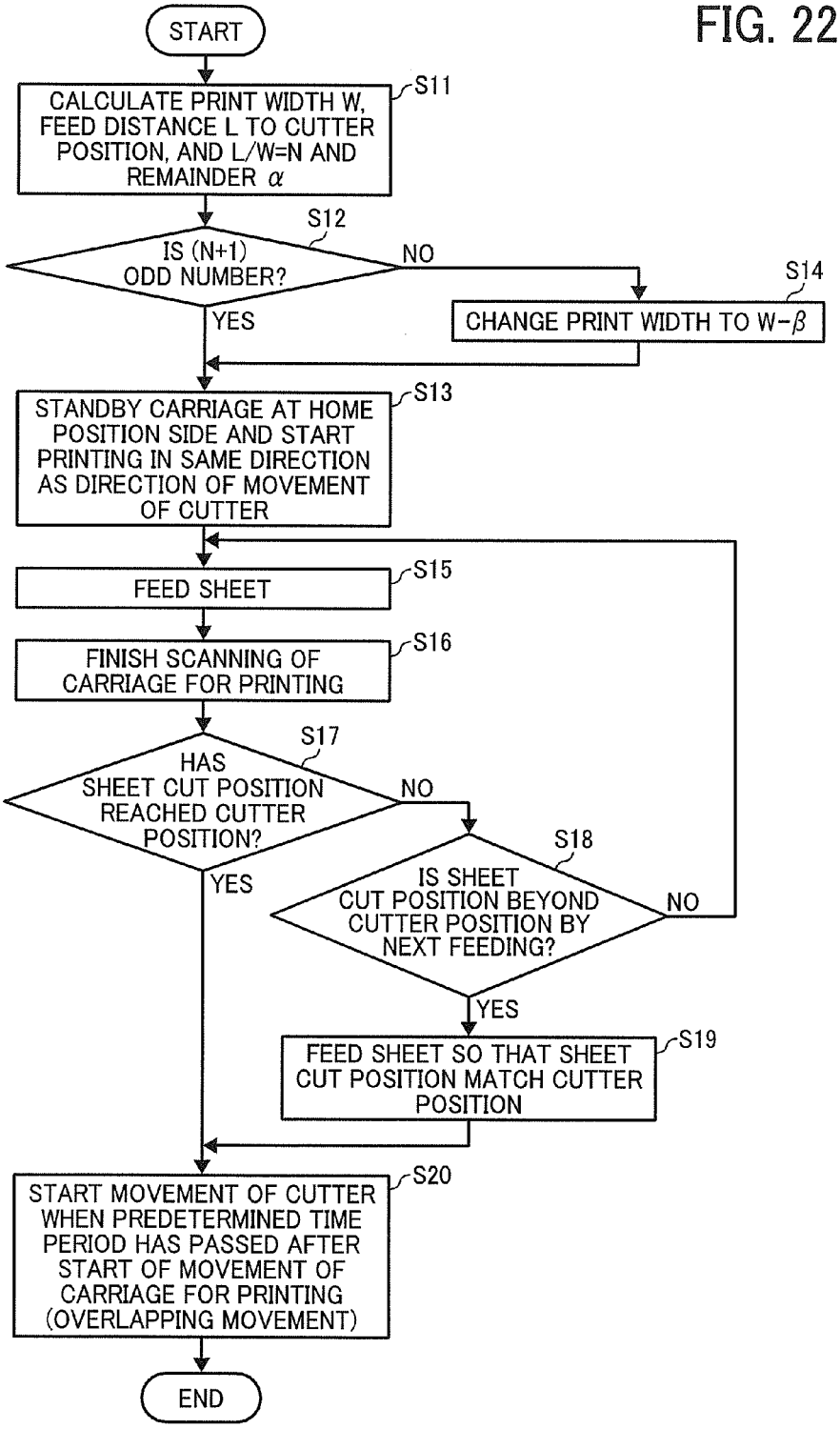
FIG. 22 is a flow chart of image recording control and movement control of the cutter unit performed by the controller according to the second embodiment of the present disclosure.

FIG. 21 is an illustration of a control to change the print width when the number of times of movement of the carriage unit 15 to be performed by when the sheet cut position of the rolled sheet 30 arrives at the cutter position is twice (even number) in a normal print width. As illustrated in FIG. 21, L represents a distance from the sheet cut position of a first sheet to the cutter position, and W represents a print width of the carriage unit 15. The cutter unit 40 cuts the rolled sheet 30 while moving from the carriage home position side to the dummy discharge side.

When the printing of the first sheet ends ((a) of FIG. 21), the rolled sheet 30 is fed downstream in the sheet feed direction by a value of W−β obtained by subtracting a predetermined value β from the print width W ((b) of FIG. 21). The value is a value set so that the number of times of movement of the carriage unit 15 is third times, and the print width is changed on printing on the leading end of the second sheet. Next, the carriage unit 15 moves in the direction indicated by arrow MD2 from the right side (the carriage home position side) to the left side (the dummy discharge side), seen from the front side of the apparatus body 1*a*, to perform print operation ((c) of FIG. 21). When the first print operation of a first sheet ends, the rolled sheet 30 is fed downstream in the sheet feed direction by the print width W ((d) of FIG. 21).

Next, the carriage unit 15, which having stood by at the dummy discharge side, moves in the direction indicated by arrow MD1 from the left side (the dummy discharge side) to the right side (the carriage home position side), seen from the front side of the apparatus body 1*a*, to perform print operation ((e) of FIG. 21). When the second print operation of the first sheet ends, the rolled sheet 30 is fed downstream in the sheet feed direction by a remaining distance of L−2W−β required for the printing of a second sheet ((f) of FIG. 21).

Thus, the carriage unit 15, which having stood by at the carriage home position side, moves in a direction indicated by arrow MD2 from the right side (the carriage home position side) to the left side (the dummy discharge side), seen from the front side of the apparatus body 1*a*, to perform print operation ((g) of FIG. 21). At this time, the cutter unit 40 performs cutting operation while moving in the same direction as the direction of movement of the carriage unit 15 ((h) of FIG. 21).

As described above, when the number of times of movement of the carriage unit 15 is twice (even number), the print width is changed on printing on the leading end of the second sheet to change the number of times of movement of the carriage unit 15 to three times (odd number). Thus, the writing direction of the carriage unit 15 and the cutting direction of the cutter unit 40 are controlled to be the same, in other words, the direction of movement of the carriage unit 15 on the leading end of the second sheet is controlled to be from the right side (the carriage home position side) to the left side (the dummy discharge side), seen from the front side of the apparatus body 1*a*. Accordingly, the direction of movement of the cutter unit 40 is the same as the direction of movement of the carriage unit 15, thus allows overlapping movement of the cutter unit 40 and the carriage unit 15.

In the above descriptions, with reference to FIG. 21, the example is described in which, when the number of times of movement of the carriage unit 15 to be performed by when the sheet cut position of the rolled sheet 30 arrives at the cutter position is twice (even number) in the normal print width, the print width is changed so that the number of movement of the carriage unit 15 is three times. Further, more generally, the case in which the number of times of movement of the carriage unit 15 is N times is described with reference to FIG. 22.

W represents a print width in which the carriage unit 15 can print in the sheet feed direction by a single movement, and L represents a distance in which the rolled sheet 30 is fed by when the sheet cut position arrives at the cutter position in a mode for forming an image by one pass (single scanning). The direction of movement of the cutter unit 40 is from the right side (the carriage home position side) to the left side (the dummy discharge side), seen from the front side of the apparatus body 1*a*.

The controller 100 calculates N and α satisfying the following formula (step S11). Here, N is a positive integer and α is a value smaller than W. L/W=N remainder α

At this time, before the trailing end of a first sheet arrives at the cutter position, print operation is performed on a second sheet by at least N+1 times of movement of the carriage unit 1.

Likewise, the rolled sheet 30 is fed at least N+1 times. When the N+1 times of sheet feeding ends, the sheet cut position of the first sheet arrives at the cutter position. After the N+1 times of movement of the carriage unit 15 ends, the cutting operation is performed.

At this time, if the direction of movement of the carriage unit 15 at the N+1 times is the same as the direction of movement of the cutter unit 40, the carriage unit 15 and the cutter unit 40 is overlappingly movable.

Next, the controller 100 determines whether the value of N+1 calculated at step S1 is odd number (step S12).

When N+1 is odd (YES at S12), the controller 100 causes the carriage unit 15 to stand by at the home position side and perform writing print operation from the right side to the left side, seen from the front side of the apparatus body 1*a*, that is, in the same direction as the direction of movement of the cutter unit 40 (step S13).

When N+1 is even (No at S12), the controller 100 changes the print width to W−β (step S14) and the process goes to step S13.

Here, the processing at each of steps S15 through S20 is the same as the processing at steps S5 through S10 in the first embodiment. Therefore, in this embodiment, redundant descriptions of steps S15 through S20 are omitted.

In the case in which the direction of movement of the cutter unit 40 is from the right side (the carriage home position side) to the left side (the dummy discharge side), seen from the front side of the apparatus body 1*a*, the above-described control causes the direction of movement of the carriage unit 15 on the leading end of the second sheet to be always from the right side to the left side, regardless of whether N+1 is odd or even. Accordingly, the direction of movement of the cutter unit 40 and the direction of movement of the carriage unit are always the same, thus allowing the cutter unit 40 and the carriage unit 15 to overlappingly move.

Alternatively, the print width of only the leading end or a predetermined print position of a sheet may be changed to match the carriage unit 15 with the direction of movement of the cutter unit 40.

For example, when printing is performed at the normal print width W, the even number of times of the carriage operation may be needed by when the sheet cut position arrives at the cutter position. In such a case, the print width on the leading end or a predetermined position of a sheet may be changed to $W-\gamma$, thus causing the number of times of the carriage operation performed by when the sheet cut position of the rolled sheet 30 arrives at the cutting position to be odd number.

In the above description, the example is described in which the number of times of the carriage operation is even number, the print width is changed so that the number of times of the carriage operation is odd number. Likewise, in the case in which the direction of operation of the cutter unit 40 is opposite (i.e., from the left side to the right side), the print width of the carriage unit 15 is changed when N+1 is odd.

As described above, for the inkjet recording apparatus 1 according to this embodiment, the print width in each carriage operation performed by when the sheet cut position arrives at the cutter position is adjusted. Even when the direction of movement of the carriage unit 15 on the leading end of a sheet is fixed, such a configuration causes the direction of movement of the cutter unit 40 and the direction of movement of the carriage unit 15 to be the same, thus allowing overlapping movement of the cutter unit 40 and the carriage unit 15.

Accordingly, the inkjet recording apparatus 1 according to this embodiment does not always restrict the movement of the carriage unit 15 during the sheet cutting operation. Therefore, for example, even in a time period to retract the carriage unit 15 to the dummy discharge position, the inkjet recording apparatus 1 can perform the sheet cutting operation and reduce the cutting time, thus enhancing the productivity.

Alternatively, the width in which the carriage unit 15 records an image in the sheet feed direction by a single movement may be changed to be uniform in a range of at least from a start position of image formation on the preceding page to when the leading end of the preceding page arrives at the sheet cutting position. With such a configuration, the cutting time can be reduced by simultaneously performing the movement operation of the cutter unit and the movement operation of the carriage unit, thus reducing the print time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

According to at least one embodiment of the present disclosure, the carriage unit and the cutter unit are overlappingly movable and the productivity can be enhanced, which is useful for image forming apparatuses.

What is claimed is:

1. An image forming apparatus comprising:

a sheet feeder configured to intermittently feed a sheet on a sheet feed path;

a carriage mounting a recording head, the recording head configured to discharge ink onto the sheet on the sheet feed path when the carriage reciprocally moves in a width direction perpendicular to a sheet feed direction in which the sheet feeder feeds the sheet;

a cutter configured to cut the sheet to a length;

a cutter unit movable in the width direction and holding the cutter, the cutter unit disposed so that a range of movement of the cutter in cutting of the sheet overlaps a range of movement of the carriage, and a controller configured to control movement of the cutter, movement of the carriage, and operation of the sheet feeder, wherein a first standby position and a second standby position are disposed on both ends of the range of movement of the carriage, and the carriage does not contact the cutter unit at each of the first standby position and the second standby position, wherein the controller is configured to control the carriage and the cutter unit to overlappingly move, and wherein, in an image recording condition in which images are consecutively recorded in a plurality of pages on the sheet, the controller changes a direction of movement of the carriage at a leading end of a page so that the direction of movement of the carriage is the same as a direction of movement of the cutter unit at a sheet cutting position at which the cutter cuts the sheet, and the controller changes the direction of movement of the carriage at a predetermined time prior to the controller controlling both the carriage and the cutter unit to move overlappingly in the same direction such that the cutter unit cuts the sheet at the sheet cutting position without contacting the carriage while the carriage simultaneously moves in the same direction as the cutter unit.

2. The image forming apparatus according to claim 1, wherein the controller is configured to calculate a natural number N obtained by a formula of L/W=N remainder $\alpha$, where L represents a feed distance by which, in image recording of a second or subsequent page, a trailing end of a preceding page is fed from a print end position for the trailing end to the sheet cutting position and W represents a width of an image recordable in the sheet feed direction by a single movement of the carriage, wherein the controller is configured to control movement of the carriage to record an image by the feed distance L by scanning the carriage N+1 times, and wherein the controller causes the direction of movement of the carriage on the leading end of the page to be the same as the direction of movement of the cutter unit when N+1 is odd and to be opposite the direction of movement of the cutter unit when N+1 is even.

3. The image forming apparatus according to claim 1, wherein each of a sheet feed condition, a carriage operation, an image recording condition is the same between a first page and a second or subsequent page of the sheet.

4. The image forming apparatus according to claim 1, wherein the recording head is configured to record an image on the sheet on the sheet feed path when the carriage and the cutter unit overlappingly move.

5. The image forming apparatus according to claim 1, wherein the cutter unit is disposed so that the range of movement of the cutter in cutting of the sheet overlaps the range of movement of the carriage in a thickness direction of the sheet, and wherein the cutter unit is configured to be movable in the width direction in a state in which the cutter unit is retracted from the sheet feed path in the thickness direction of the sheet after the sheet is cut by the cutter.

6. An image forming apparatus comprising:

a sheet feeder configured to intermittently feed a sheet on a sheet feed path;

a carriage mounting a recording head, the recording head configured to discharge ink onto the sheet on the sheet feed path when the carriage reciprocally moves in a width direction perpendicular to a sheet feed direction in which the sheet feeder feeds the sheet;

a cutter configured to cut the sheet to a length;

a cutter unit movable in the width direction and holding the cutter, the cutter unit disposed so that a range of movement of the cutter in cutting of the sheet overlaps a range of movement of the carriage, and a controller configured to control movement of the cutter, movement of the carriage, and operation of the sheet feeder, wherein a first standby position and a second standby position are disposed on both ends of the range of movement of the carriage, the carriage does not contact the cutter unit at each of the first standby position and the second standby position, wherein the controller is configured to control the carriage and the cutter unit to overlappingly move, and wherein, in an image recording condition in which images are consecutively recorded in a plurality of pages on the sheet, the controller changes a width of an image in the sheet feed direction recorded by a single movement of the carriage by when a sheet cut position of the sheet, at which the sheet is cut by the cutter, arrives at a sheet cutting position of the cutter, at which the cutter cuts the sheet, so that the direction of movement of the carriage is the same as a direction of movement of the cutter unit at the sheet cutting position, and the controller changes the direction of movement of the carriage at a predetermined time prior to the controller controlling both the carriage and the cutter unit to move overlappingly in the same direction such that the cutter unit cuts the sheet at the sheet cutting position without contacting the carriage while the carriage simultaneously moves in the same direction as the cutter unit.

7. The image forming apparatus according to claim 6, wherein, after the controller changes the width of the image in the sheet feed direction recorded by the single movement of the carriage, the width of the image is uniform in at least a range from an image formation start position of a preceding page to when a leading end of the preceding page arrives at the sheet cutting position.

8. The image forming apparatus according to claim 6, wherein each of a sheet feed condition, a carriage operation, an image recording condition is the same between a first page and a second or subsequent page of the sheet.

9. The image forming apparatus according to claim 6, wherein the recording head is configured to record an image on the sheet on the sheet feed path when the carriage and the cutter unit overlappingly move.

10. The image forming apparatus according to claim 6, wherein the cutter unit is disposed so that the range of movement of the cutter in cutting of the sheet overlaps the range of movement of the carriage in a thickness direction of the sheet, and wherein the cutter unit is configured to be movable in the width direction in a state in which the cutter unit is retracted from the sheet feed path in the thickness direction of the sheet after the sheet is cut by the cutter.

11. An image forming method comprising:

calculating, from a feed distance of a sheet to a sheet cutting position of the cutter at which a cutter of a cutter unit of an image forming apparatus cuts the sheet, a number of times of scanning of a carriage to be performed by when a sheet cut position of the sheet, at which the sheet is cut by the cutter, arrives at the sheet cutting position;

determining whether the number of times of scanning of the carriage is even or odd, to determine a writing direction of the carriage;

feeding the sheet so that the sheet cut position matches the sheet cutting position; and driving the cutter unit during print operation of the carriage so that the cutter unit and the carriage move overlappingly in the same direction after a predetermined time has passed from movement of the carriage such that the cutter unit cuts the sheet at the sheet cutting position without contacting the carriage unit while the carriage simultaneously moves in the same direction as the cutter unit.

* * * * *